US008641461B2

(12) United States Patent
Mitose et al.

(10) Patent No.: US 8,641,461 B2
(45) Date of Patent: Feb. 4, 2014

(54) CRIMP TERMINAL, CONNECTION STRUCTURAL BODY AND METHOD FOR PRODUCING THE CRIMP TERMINAL

(75) Inventors: Kengo Mitose, Tokyo (JP); Yukihiro Kawamura, Shiga (JP)

(73) Assignees: Furukawa Electric Co., Ltd., Tokyo (JP); Furukawa Automotive Systems Inc., Shiga (JP)

( * ) Notice: Subject to any disclaimer, the term of this patent is extended or adjusted under 35 U.S.C. 154(b) by 0 days.

(21) Appl. No.: 13/567,626

(22) Filed: Aug. 6, 2012

(65) Prior Publication Data

US 2013/0040509 A1 Feb. 14, 2013

Related U.S. Application Data

(63) Continuation of application No. PCT/JP2011/052401, filed on Feb. 4, 2011.

(30) Foreign Application Priority Data

Feb. 5, 2010 (JP) ..... 2010-024607

(51) Int. Cl.
*H01R 4/10* (2006.01)

(52) U.S. Cl.
USPC ..... 439/877; 439/587

(58) Field of Classification Search
USPC ..... 439/877, 865, 867, 868, 882, 886, 852
See application file for complete search history.

(56) References Cited

U.S. PATENT DOCUMENTS

| | | | | |
|---|---|---|---|---|
| 6,840,804 | B2 * | 1/2005 | Murakami et al. | 439/587 |
| 7,033,215 | B2 * | 4/2006 | Kobayashi | 439/587 |
| 7,306,495 | B2 * | 12/2007 | Hashimoto et al. | 439/877 |
| 7,883,365 | B2 * | 2/2011 | Saitou | 439/587 |
| 2001/0049226 | A1 * | 12/2001 | Murakami et al. | 439/587 |

FOREIGN PATENT DOCUMENTS

| | | | |
|---|---|---|---|
| JP | 2004-199934 | A | 7/2004 |
| JP | 2004-207172 | A | 7/2004 |
| JP | 2005-108608 | A | 4/2005 |
| JP | 2010-165514 | A | 7/2010 |
| JP | 2010-257719 | A | 11/2010 |

OTHER PUBLICATIONS

International Search Report issued in PCT/JP2011/052401, mailed Mar. 8, 2011, 2 pages.

* cited by examiner

*Primary Examiner* — Amy Cohen Johnson
*Assistant Examiner* — Vladimir Imas
(74) *Attorney, Agent, or Firm* — Osha Liang LLP

(57) ABSTRACT

Has an object of providing a crimp terminal, a connection structural body, and a method for producing the crimp terminal, which has a conducting function with certainty, with no galvanic corrosion occurring due to an electric wire and the terminal formed of different metal materials. A crimp terminal 1 includes a box section, and a pressure-bonding section including a wire barrel section and an insulation barrel section, which are provided in this order. The crimp terminal is formed of a metal plate which is formed of a copper alloy having a higher potential than aluminum used to form core wires of an insulated wire which is to be pressure-bonded by the pressure-bonding section. The crimp terminal 1 includes, in at least a part thereof, a resin cover section for covering a surface of the metal plate with a resin.

8 Claims, 17 Drawing Sheets

CRIMP TERMINAL, CONNECTION STRUCTURAL BODY AND METHOD FOR PRODUCING THE CRIMP TERMINAL

TECHNICAL FIELD

The present invention relates to a crimp terminal attachable to, for example, a connector or the like for connection of a wire harness for an automobile, and a connection structural body including the same; and in more detail, to a crimp terminal connectable to a wire harness formed of an aluminum conductor or an aluminum alloy conductor, and a connection structural body including the same.

BACKGROUND ART

Today, carbon dioxide emissions from automobiles are required to be reduced. Since reduction of weight of vehicles greatly influences improvement of fuel efficiency, the weight of wire harnesses for connecting electrical components are also required to be reduced. Therefore, it has been studied to, for example, replace copper-based materials which are conventionally used for electric wires or the like used for the wire harnesses with aluminum, and aluminum has been used for some electric wires.

However, an electrical structural body including an aluminum wire pressure-bonded to a crimp terminal has a problem that aluminum having a low potential is corroded as a result of contacting a metal material having a high potential, such as tin or gold used to plate the terminal, or such as a copper alloy used for forming the terminal; namely, has a problem of galvanic corrosion.

The above-mentioned galvanic corrosion is a phenomenon that when water is attached to a site at which a metal material having a high potential and a metal material having a low potential contact each other, a corrosion current is generated, and as a result, the metal material having a low potential is, for example, corroded, dissolved, or extinguished. In the case of a connection structural body mentioned above, the aluminum wire pressure-bonded to a pressure-bonding section of the terminal is corroded, dissolved, or extinguished, and thus the electric resistance is raised. This causes a problem that the connection structural body cannot exhibit a sufficient conducting function.

According to a technology which is proposed to prevent the galvanic corrosion of such an aluminum wire used in a connection structural body, a main body of the crimp terminal is formed of an aluminum material and an elastic piece for supporting a contact of the crimp terminal, which is to be in contact with a connection terminal used for electrical connection, is formed of an iron-based material (see Patent Document 1). It is described that this can prevent the galvanic corrosion of the aluminum wire.

However, the technology described in Patent Document 1 is difficult to be applied to the conventional processing procedure for producing a terminal, namely, a continuous procedure of punching out the material of the terminal with a press and bending the material. Thus, it is difficult to mass-produce the terminal with the technology described in Patent Document 1. In addition, the technology described in Patent Document has a problem that galvanic corrosion occurs due to the material used to form the elastic piece and aluminum used to form the main body of the terminal.

According to another proposal to prevent the galvanic corrosion of the aluminum wire, core wires exposed from an end of the electric wire is covered with an intermediate gap to conduct and thus connect the core wires and the intermediate gap to each other, and also the intermediate cap and a metal fitting of the terminal are conducted and thus connected to each other, so that the electric wire and the metal fitting of the terminal are conducted and connected to each other (see Patent Document 2).

Patent Document 2 describes as follows: although the electric wire and the intermediate cap formed of different metal materials contact each other, the contact site is not exposed owing to the above-described structure; and as a result, water is not attached to the contact site and thus galvanic corrosion is not caused. It is expected based on this structure that the galvanic corrosion can be also prevented by applying an organic material such as a grease or a resin to an exposed part of the aluminum wire in the connection structural body.

However, the proposal described in Patent Document 2 complicates the structure for pressure-bonding the electric wire. Therefore, it is difficult to optimize the pressure-bonding conditions, namely, the caulking conditions. In addition, the proposal described in Patent Document 2 has a problem that a tiny gap or the like is made, and thus galvanic corrosion advances rapidly, which makes it difficult to maintain the conducting function.

In the case where an organic material such as a grease or a resin is applied to the exposed part of the electric wire as described above, it is not easy to apply such a gris, resin, etc. to a pressure-bonding section having a complicated structure in a highly airtight state for the purpose of, for example, guarantee durability of an automobile against long-time use. There is a risk that, for example, galvanic corrosion proceeds rapidly from a gap such as a crack or the like made as a result of long-time use.

CITATION LIST

Patent Literature

Patent Document 1: Japanese Laid-Open Patent Publication No. 2004-199934

Patent Document 2: Japanese Laid-Open Patent Publication No. 2004-207172

SUMMARY OF INVENTION

Technical Problem

The present invention has an object of providing a crimp terminal, a connection structural body, and a method for producing the crimp terminal, which have a conducting function with certainty, with no galvanic corrosion occurring due to an electric wire and the terminal formed of different metal materials.

Solution to Problem

The present invention is directed to a crimp terminal, comprising a connection section, and a pressure-bonding section including a wire barrel section and an insulation barrel section, which are provided in this order; and a transition section provided between the connection section and the wire barrel section and between the wire barrel section and the insulation barrel section; wherein the crimp terminal is formed of a metal plate which is formed of a metal material having a higher potential than a metal material used to form a conductor part of an insulated wire which is to be pressure-bonded by the pressure-bonding section; and the crimp terminal includes, in at least a part thereof, a resin cover section for covering a surface of the metal plate with a resin.

The metal material having a high potential which is used for forming the metal plate may be a metal material, such as copper, tin or the like, which has a small ionization tendency and a high potential than those of the conductor part formed of, for example, aluminum.

The connection section may be a male tab of a male terminal, a box section of a female terminal, or the like.

Owing to the above-described structure, a crimp terminal having a conducting function with certainty, with no galvanic corrosion occurring due to contact with a conductor part of the insulated wire formed of a different metal material from that of the crimp terminal. In more detail, the crimp terminal includes, in at least a part thereof, a resin cover section for covering a surface of the metal plate with a resin. Therefore, the exposed area size of the surface of the metal plate which is formed of a metal material having a high potential is reduced with respect to the exposed area size of the conductor part. This prevents generation of a corrosion current. Thus, galvanic corrosion of a contact area of the conductor part of the insulated wire and the crimp terminal can be prevented while the conducting function is guaranteed.

In an embodiment of the present invention, the crimp terminal may include, as the resin cover section, at least a transition cover section for covering an inner surface of the transition section.

The transition cover section may be a cover section for covering only the transition section, or a cover section for integrally covering the transition section and another area.

Owing to the above-described structure, the transition cover section is provided at a contact area of the conductor part and the inner surface of the transition section. Therefore, galvanic corrosion can be effectively prevented.

In an embodiment of the present invention, the crimp terminal may include, as the resin cover section, at least a wire barrel cover section for covering a surface of the wire barrel section. The ratio of a length of the resin cover part of the wire barrel cover sections with respect to a barrel length may be 0.2 to 0.6.

The wire barrel cover section may be a cover section continuous to another cover section, such as the transition cover section or the like, for covering another area; a cover section for covering only the wire barrel section; or a cover section independent from another cover section, such as the transition cover section or the like, for covering another area. The wire barrel cover section may be independently provided on each of both sides, in the longitudinal direction, of the wire barrel section for connecting the connection section and the insulation barrel section, or may be provided over the wire barrel section with a large width.

The length of the resin cover part of the wire barrel cover sections may be the length of the resin cover part in the wire barrel section in the longitudinal direction.

The barrel length may be the length, in the longitudinal direction, of the wire barrel section for connecting the connection section and the insulation barrel section.

Owing to the above-described structure, a pressure-bonding/connection state for preventing galvanic corrosion while providing a conducting function with more certainty can be provided. In more detail, when the ratio of the length of the resin cover part of the wire barrel cover sections with respect to the barrel length is less than 0.2, galvanic corrosion is likely to occur at both of edges of the wire barrel section. When the ratio of the length of the resin cover part of the wire barrel cover sections with respect to the barrel length exceeds 0.6, the contact resistance of the pressure-bonding section is too high. Therefore, by setting the ratio of the length of the resin cover part of the wire barrel cover sections to 0.2 to 0.6, galvanic corrosion of the aluminum electric wires at both of edges of the wire barrel section can be prevented, and the contact resistance of the pressure-bonding section can be made sufficiently low.

In an embodiment of the present invention, a cover thickness of the resin cover section may be 5 μm or more and 30 μm or less.

Owing to this structure, the effect of preventing galvanic corrosion can be improved while the conducting performance of the conductor part and the crimp terminal is guaranteed. In more detail, when the cover thickness of the resin cover section is less than 5 μm, the resin cover section as an insulating layer cannot cover sufficiently and may undesirably permeate moisture. If this occurs, the metal material having a high potential which is used for the metal plate cannot be prevented from acting as a cathode. By contrast, when the cover thickness of the resin cover section exceeds 30 μm, electric conduction between the exposed metal part which is not covered with the resin cover section and the conductor part is inhibited inside the wire barrel section of the pressure-bonding section. This increases the contact resistance. By setting the cover thickness of the resin cover section to 5 μm or more and 30 μm or less, the surface of the terminal can be sufficiently insulated and thus the metal plate is prevented from acting as a cathode. Thus, galvanic corrosion of the conductor part can be prevented while the sufficient conducting performance is guaranteed.

In an embodiment of the present invention, the crimp terminal may include an end surface cover section for covering at least a part of an end surface of the metal plate with the resin.

When the metal plate is processed, for example, cut or punched out to obtain a desired shape, an end surface of the metal material formed into the desired shape is exposed, and the exposed metal part of the metal material acts as a cathode when contacting the conductor part. As a result, galvanic corrosion occurs in the conductor part. However, when the exposed end surface of the metal plate is covered with an end surface cover section, the end surface is prevented from acting as a cathode. Thus, galvanic corrosion of the conductor part can be prevented.

The present invention is also directed to a connection structural body including the above-described crimp terminal; and the conductor part pressure-bonded and connected to the pressure-bonding section of the crimp terminal. In an embodiment of the present invention, an exposed part of the conductor part in the transition section may be covered with a resin.

Owing to this structure, the exposed part of the conductor part in the transition section is atmospherically isolated from outside. Therefore, galvanic corrosion of the conductor part can be prevented with more certainty.

The cover area ratio, which is the ratio of the size of the area covered with the resin cover section, with respect to the total surface area of the metal plate, is 10% or more. The upper limit of the cover area ratio is desirably 50% to 90%, although varying in accordance with the size of the terminal or the aluminum conductor.

The present invention is also directed to a method for producing a crimp terminal. The crimp terminal includes a connection section, and a pressure-bonding section including a wire barrel section and an insulation barrel section, which are provided in this order; and a transition section provided between the connection section and the wire barrel section and between the wire barrel section and the insulation barrel section; wherein the crimp terminal is formed of a metal plate which is formed of a metal material having a higher potential than a metal material used to form a conductor part of an insulated wire which is to be pressure-bonded by the pressure-bonding section. The method comprises a step of forming a cover on a surface of the metal plate by applying and sintering a resin, and a step of, thereafter, treating the cover with reflow tin plating.

Owing to this structure, a crimp terminal having an effect of preventing galvanic corrosion while guaranteeing the conducting performance can be produced with certainty.

Advantageous Effects of Invention

The present invention provides a crimp terminal, a connection structural body, and a method for producing the crimp terminal, which have a conducting function with certainty, with no galvanic corrosion occurring due to an electric wire and the terminal formed of different metal materials.

Also according to the present invention, the terminal can be produced by a conventional procedure, namely, a continuous procedure of punching out the material of the terminal with a press and bending the material. Thus, the connection structural body can be produced by use of the conventional pressure bonding operation, which provides an advantage that the mass-productivity is high.

DESCRIPTION OF EMBODIMENTS

An embodiment of the present invention will be described with reference to the drawings.

Example 1

Figures 1A, 1B, 1C:
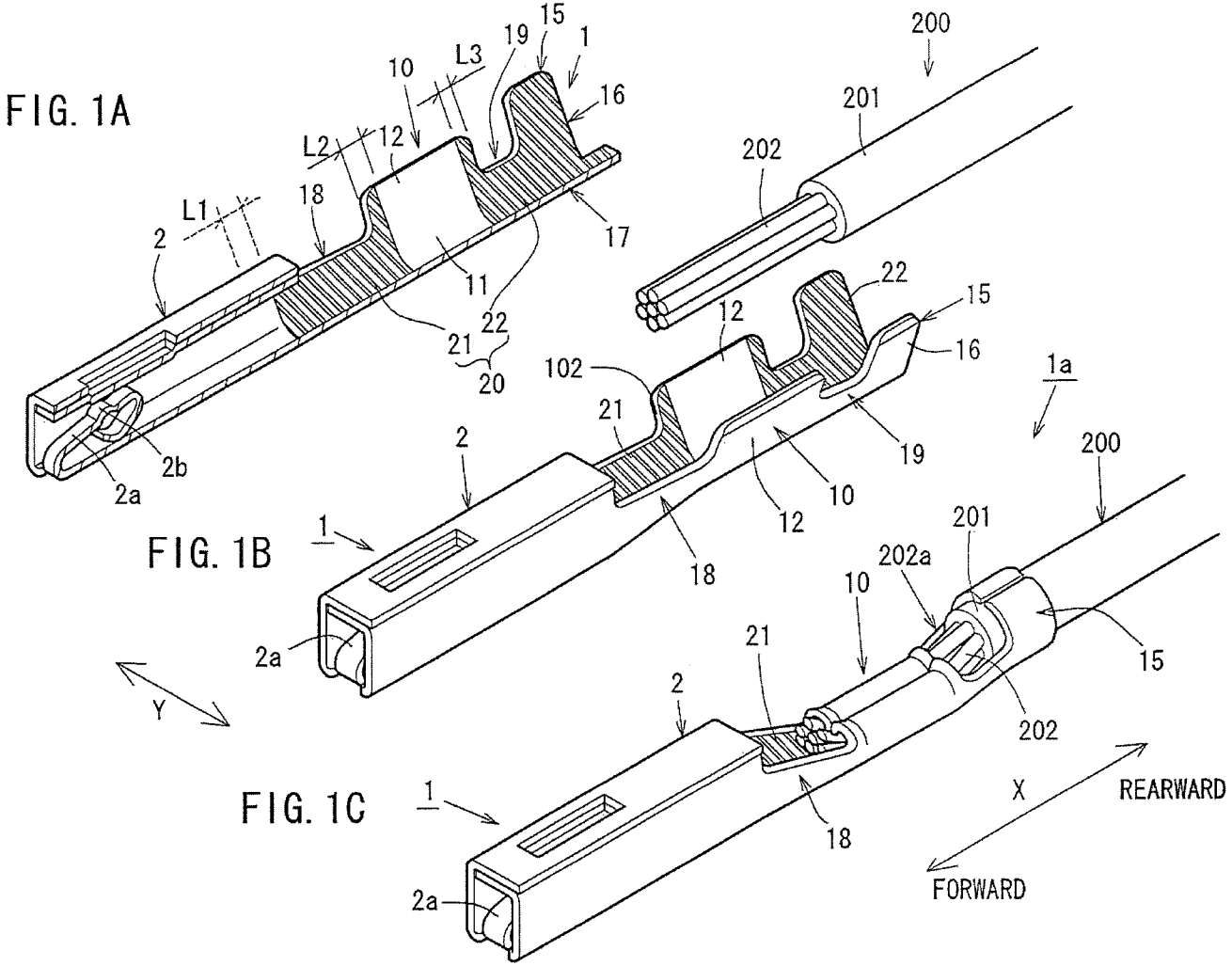
FIG. 1 shows a crimp terminal and a connection structural body in a first pattern.
Figures 2A, 2B, 2C:
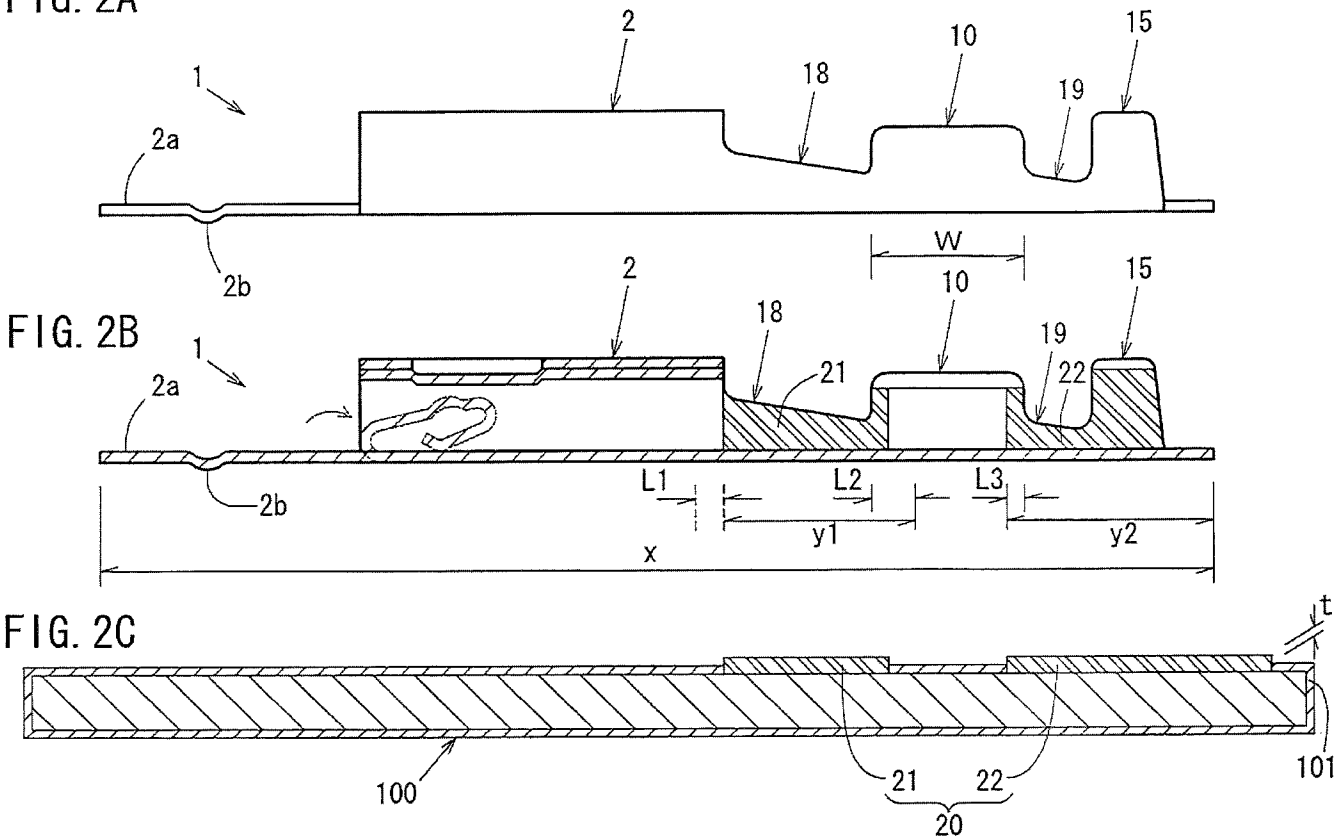
FIG. 2 shows the crimp terminal in the first pattern.
Figure 3A:
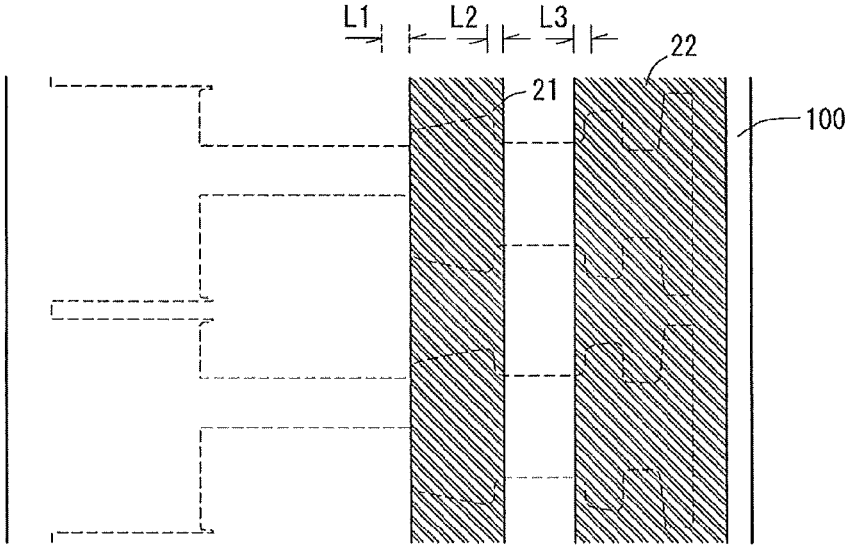
FIG. 3 shows a metal plate in the first pattern.
Figure 3B:
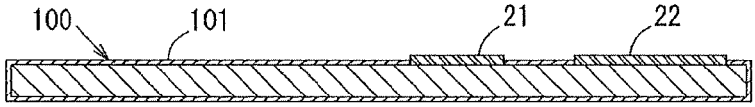
Figure 3C:
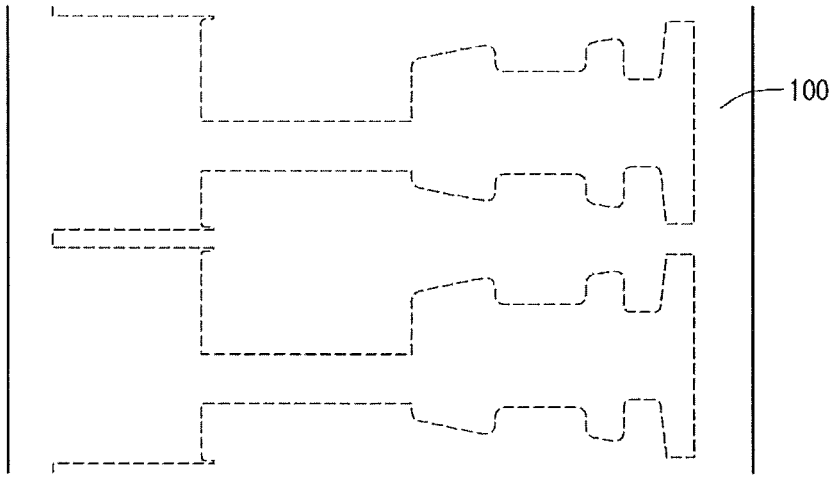
Figures 4A, 4B, 4C:
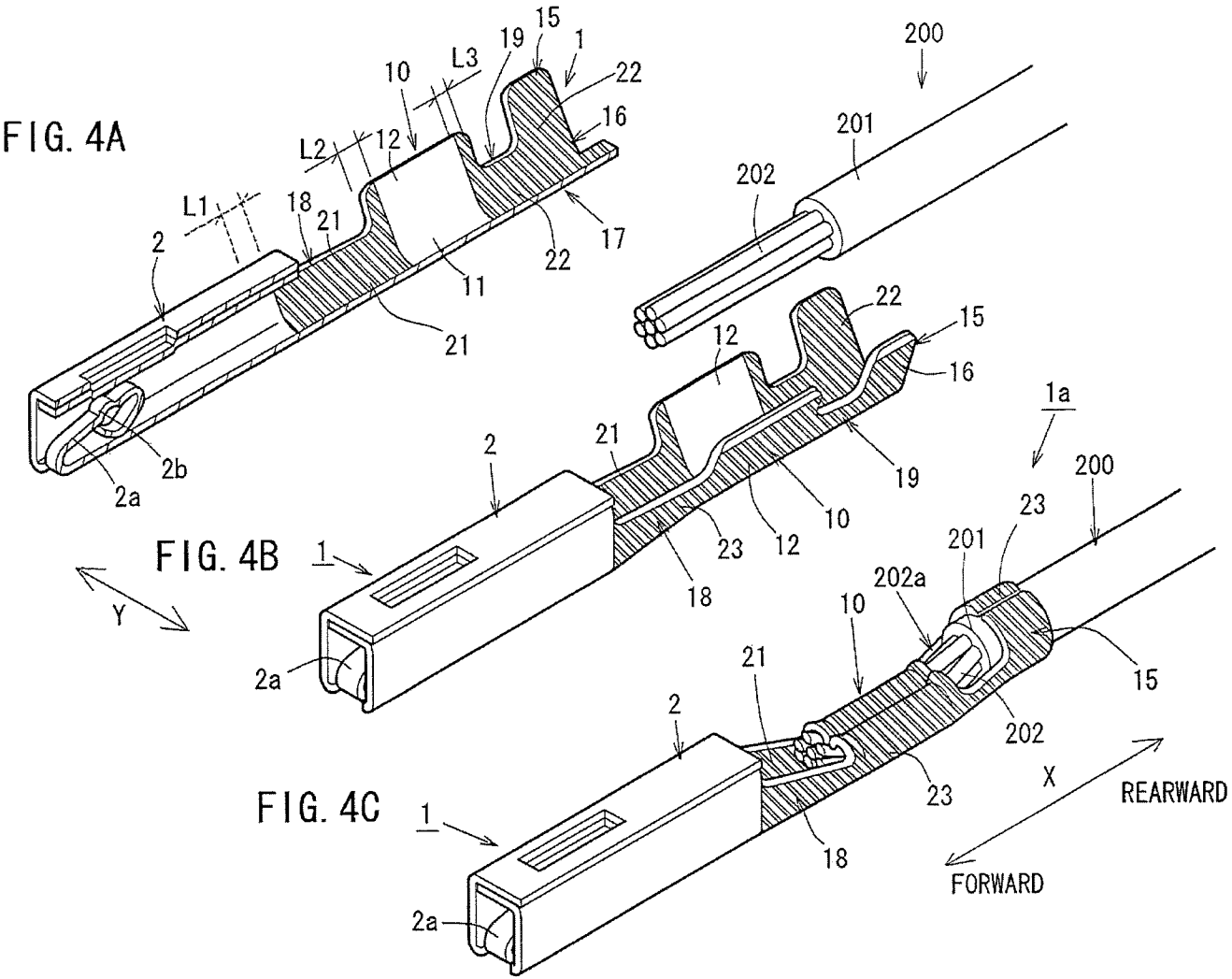
FIG. 4 shows a crimp terminal and a connection structural body in a second pattern.
Figures 5A, 5B:
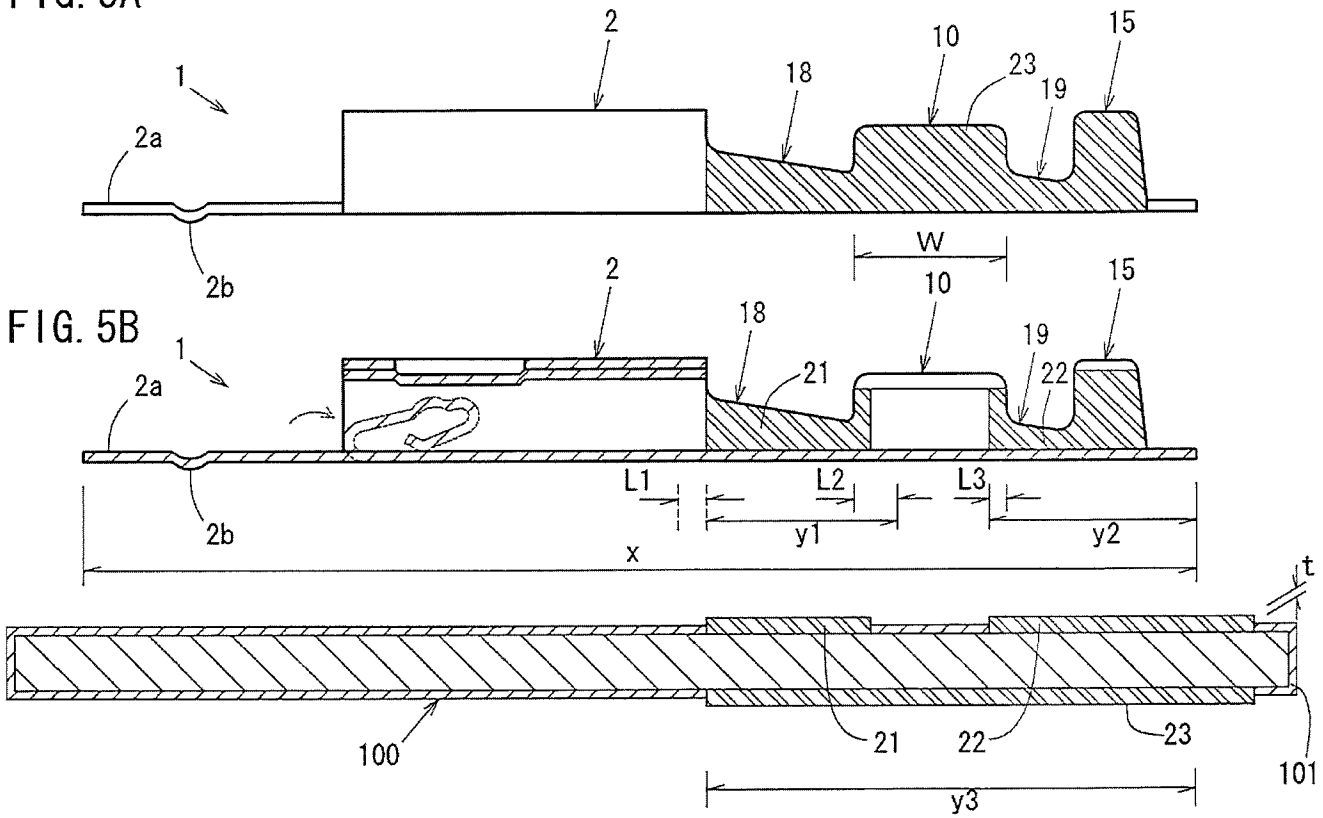
FIG. 5 shows the crimp terminal in the second pattern.
Figure 6A:
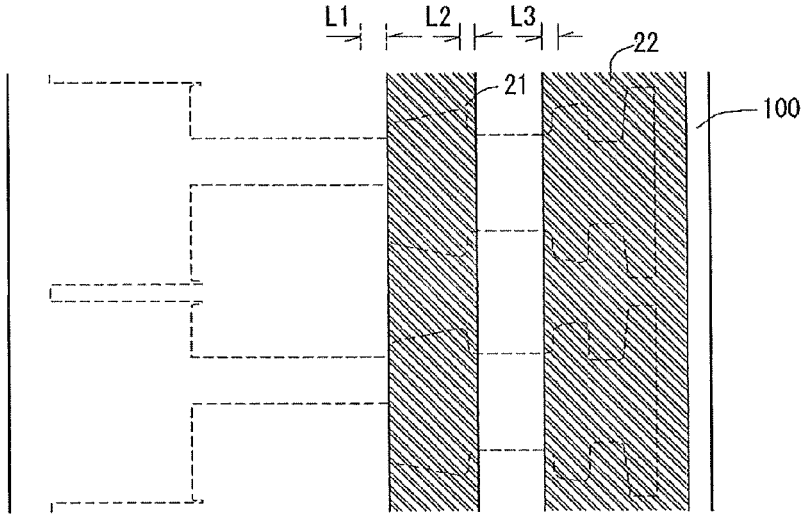
FIG. 6 shows a metal plate in the second pattern.
Figure 6B:
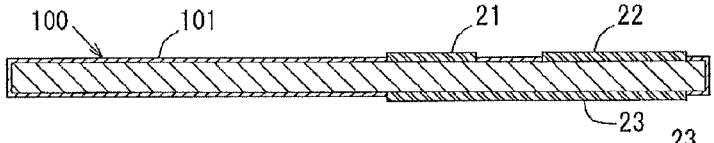
Figure 6C:
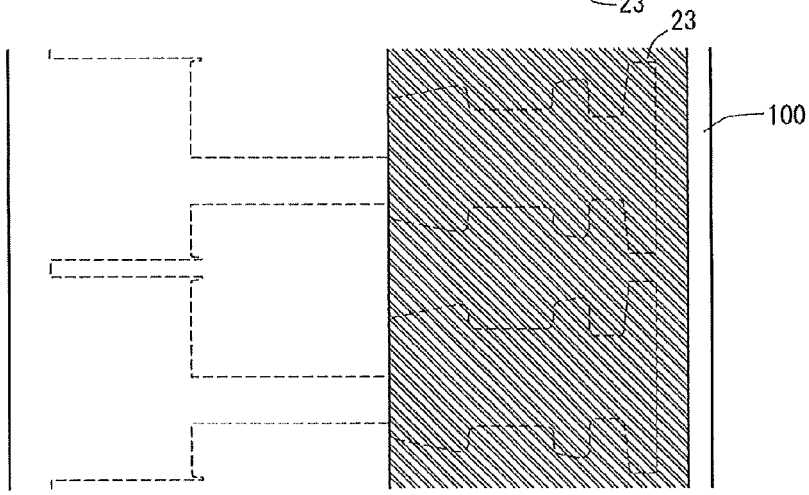
Figures 7A, 7B, 7C:
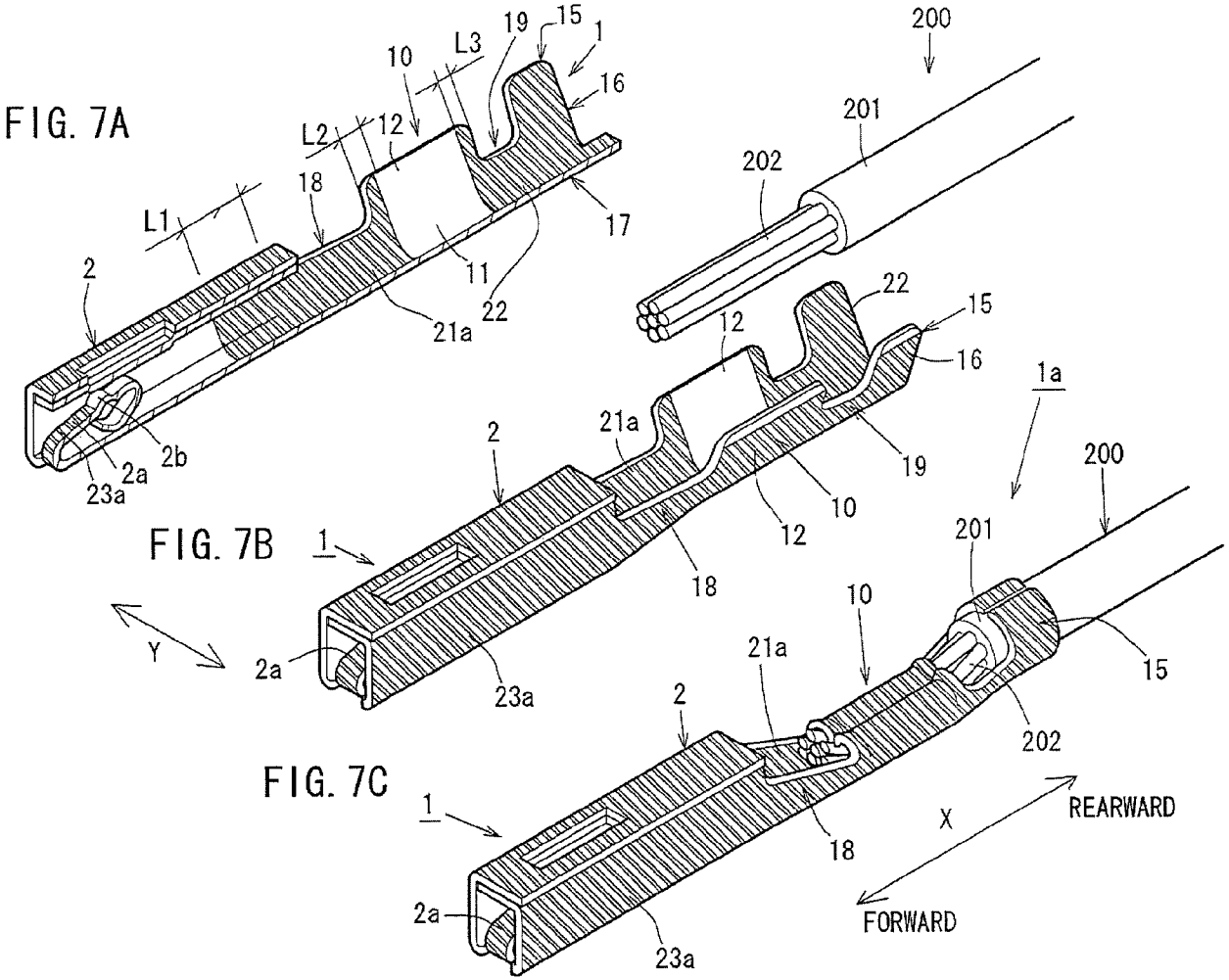
FIG. 7 shows a crimp terminal and a connection structural body in a third pattern.
Figures 8A, 8B, 8C:
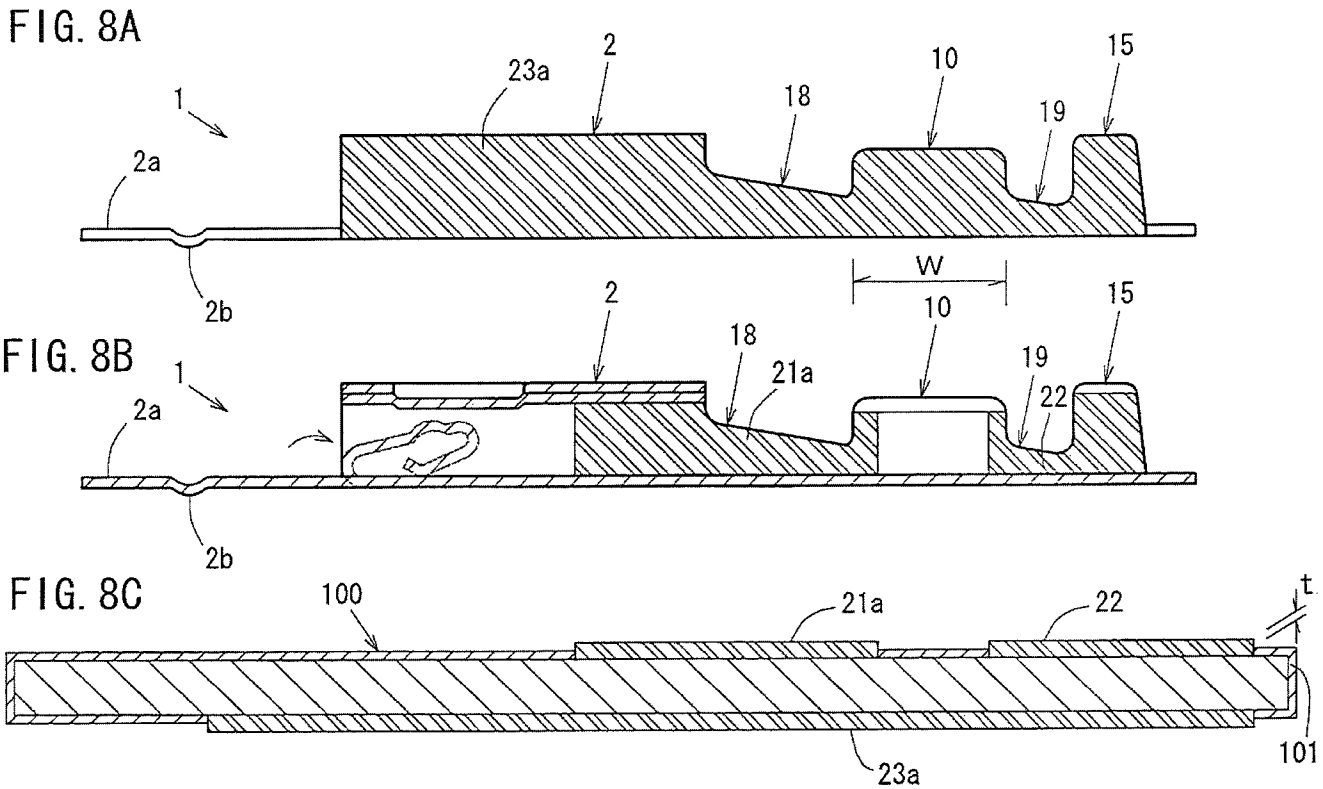
FIG. 8 shows the crimp terminal in the third pattern.
Figure 9A:
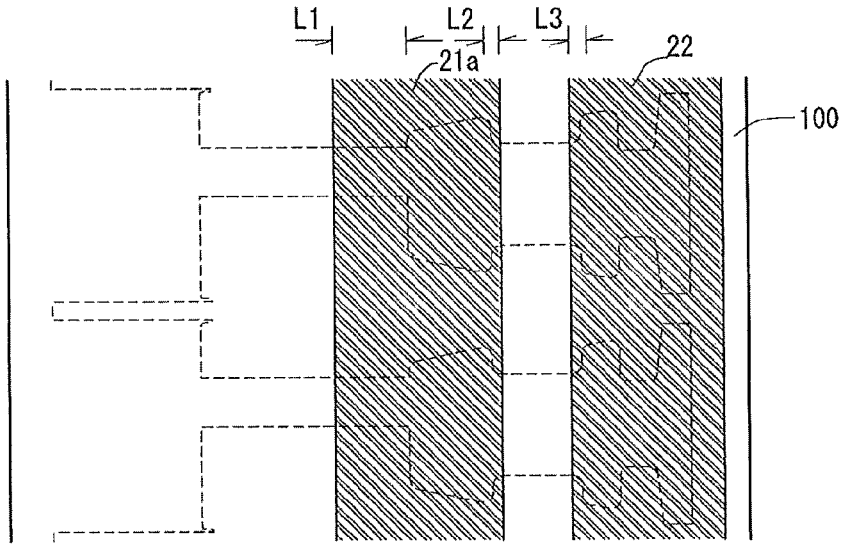
FIG. 9 shows a metal plate in the third pattern.
Figure 9B:
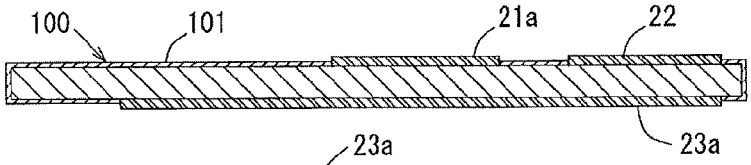
Figure 9C:
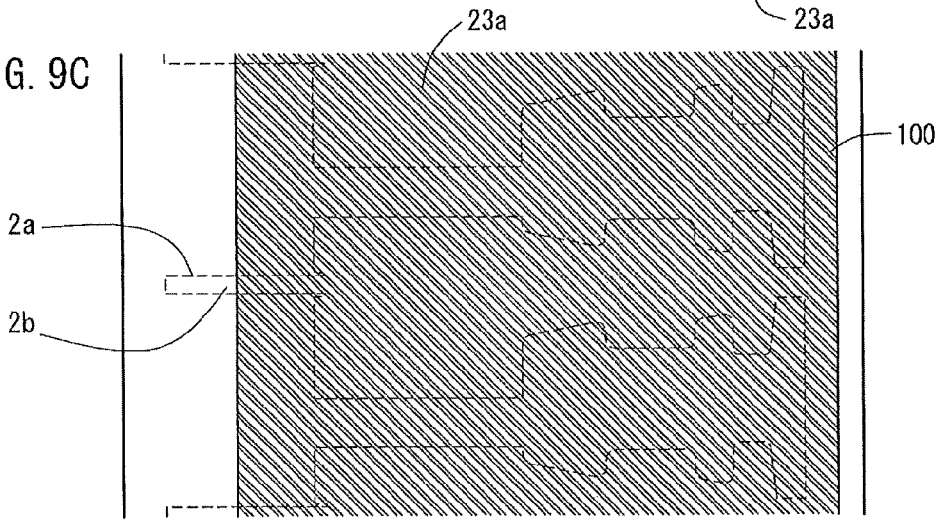
Figures 10A, 10B, 10C:
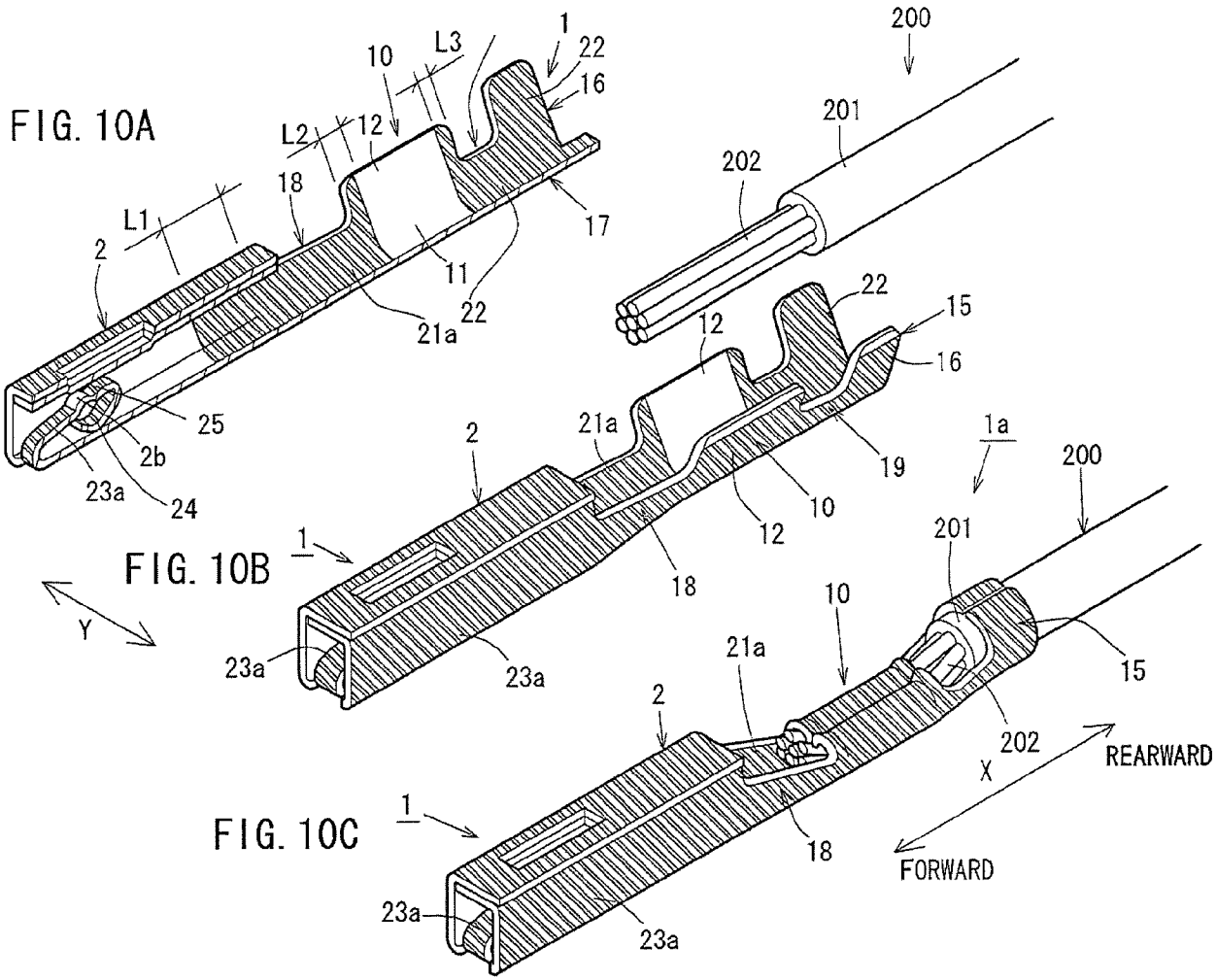
FIG. 10 shows a crimp terminal and a connection structural body in a fourth pattern.
Figures 11A, 11B, 11C:
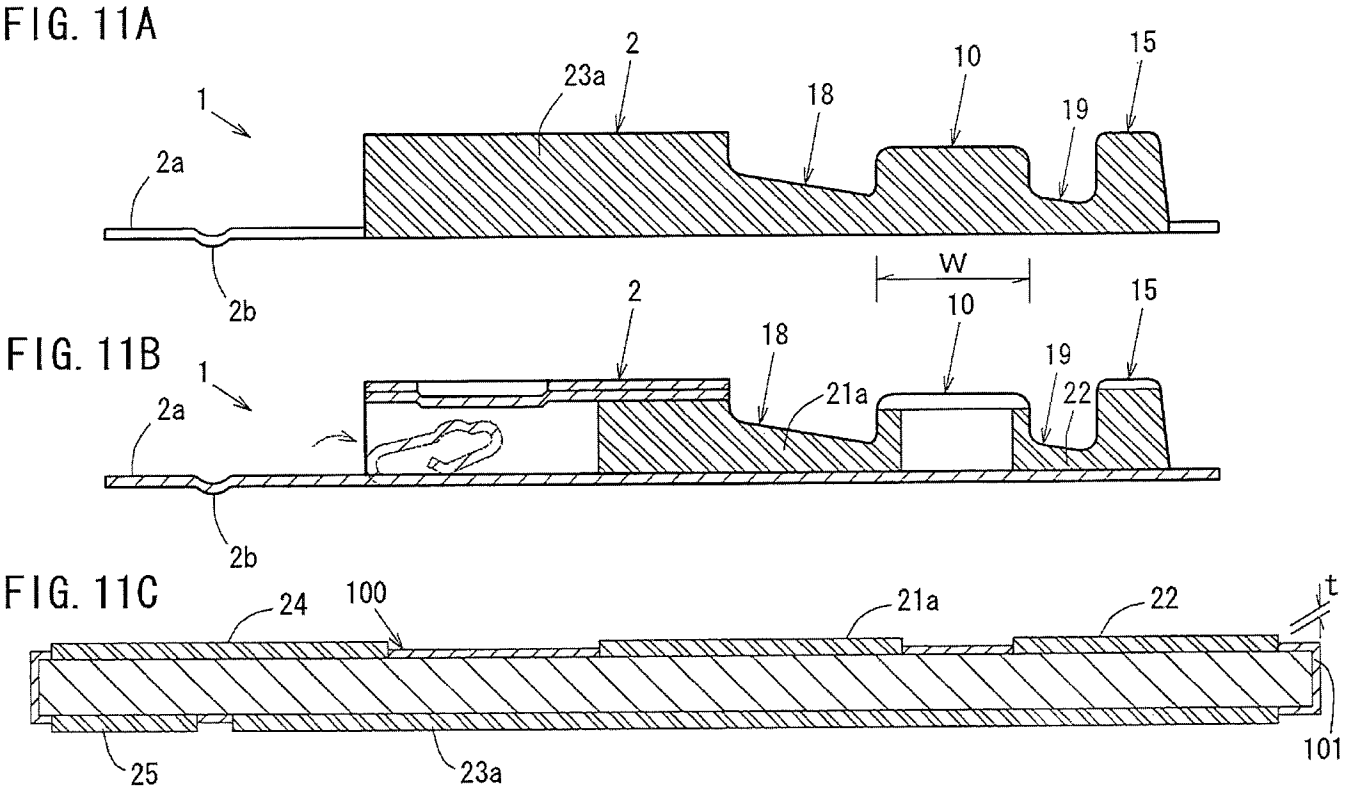
FIG. 11 shows the crimp terminal in the fourth pattern.
Figure 12A:
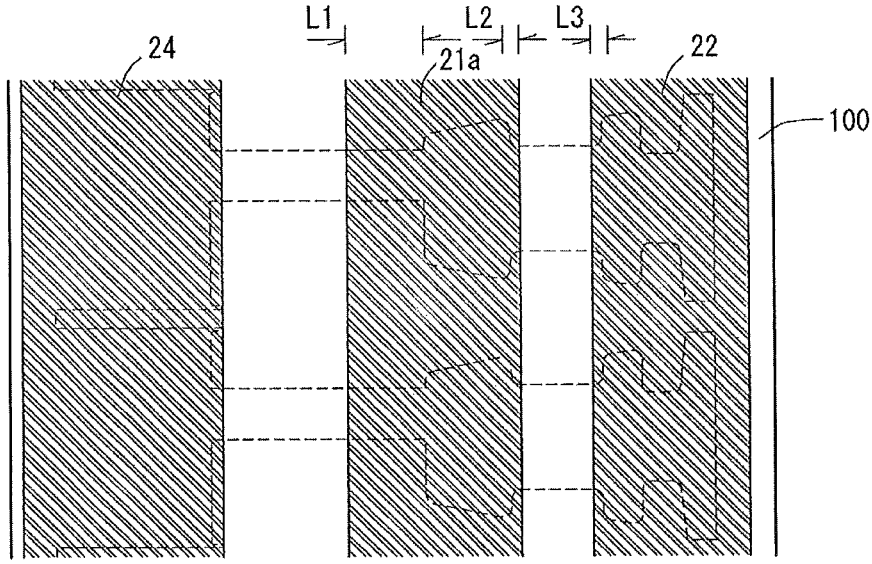
FIG. 12 shows a metal plate in the fourth pattern.
Figure 12B:
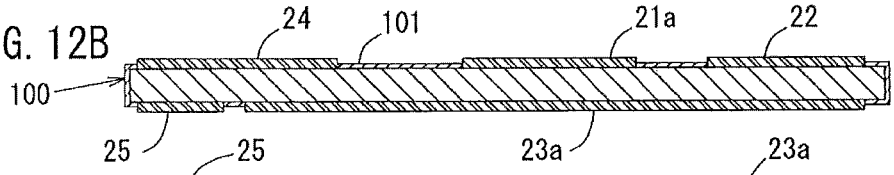
Figure 12C:
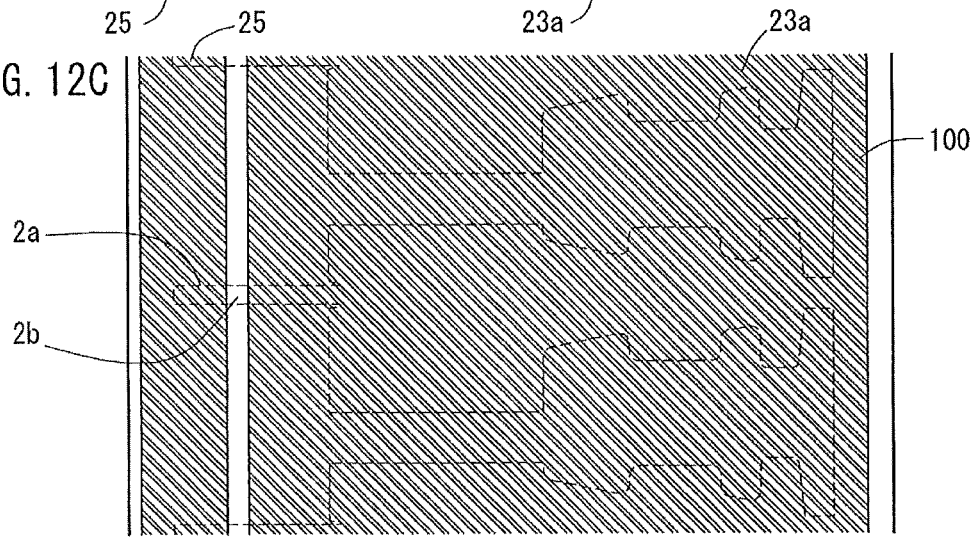

FIG. 1 provides isometric views of a crimp terminal 1 and a connection structural body 1*a* in a first pattern. FIG. 2 provides a side view and vertical cross-sectional views of the crimp terminal 1 in the first pattern. FIG. 3 shows a metal plate 100 in the first pattern. Similarly, FIGS. 4 through 6 show a second pattern. FIGS. 7 through 9 show a third pattern. FIGS. 10 through 12 show a fourth pattern.

FIGS. 1(*a*), 4(*a*), 7(*a*) and 10(*a*) are each an isometric view of the crimp terminal 1 which is cut off at a center thereof in a width direction. FIGS. 1(*b*), 4(*b*), 7(*b*) and 10(*b*) are each an isometric view of the crimp terminal 1 and an insulated wire 200 before being pressure-bonded to each other. FIGS. 1(*c*), 4(*c*), 7(*c*) and 10(*c*) are each an isometric view of the connection structural body 1*a* obtained as a result of pressure-bonding and thus connecting the crimp terminal 1 and the electric wire 200 to each other.

FIGS. 2(*a*), 5(*a*), 8(*a*) and 11(*a*) are each a side view of the crimp terminal 1 in an incomplete state before a contact piece 2*a* is bent. FIGS. 2(*b*), 5(*b*), 8(*b*) and 11(*b*) are each a vertical cross-sectional view of the crimp terminal 1 in the same state. FIGS. 2(*c*), 5(*c*), 8(*c*) and 11(*c*) are each a schematic enlarged cross-sectional view of the metal plate 100 which is to be formed into the crimp terminal 1.

FIGS. 3(*a*), 6(*a*), 9(*a*) and 12(*a*) are each a plan view of the metal plate 100 before being punched into a shape of the crimp terminal 1 to form a reel. FIGS. 3(*c*), 6(*c*), 9(*c*) and 12(*c*) are each a bottom view of the metal plate 100 in the same state. FIGS. 3(*b*), 6(*b*), 9(*b*) and 12(*b*) are each a schematic cross-sectional view of the metal plate 100 which is to be formed into the crimp terminal 1. The metal plate 100 in each of FIGS. 3(*b*), 6(*b*), 9(*b*) and 12(*b*) is shown to be thicker than the actual thickness in order to clearly show the positions on a surface of the metal plate 100 at which resin cover sections 20 are formed and plated.

First, the crimp terminal 1 in the first pattern will be described. The crimp terminal 1 is of a female type, and includes, from a forward end to a rearward end in a longitudinal direction X thereof, a box section 2 for allowing insertion of a male tab of a male terminal (not shown), a wire barrel section 10 located rearward to the box section 2 with a first transition 18 of a prescribed length interposed therebetween, and an insulation barrel section 15 located rearward to the wire barrel section 10 with a second transition 19 of a prescribed length interposed therebetween. These elements are integrally formed.

The wire barrel section 10 caulks and thus pressure-bonds core wires 202 of the insulated wire 200. The insulation barrel section 15 caulks and thus fixes an insulating cover 201 of the insulated wire 200. Thus, the connection structural body 1 is formed.

The insulated wire 200 is formed as follows. Along with the recent trend for reduced size and weight, the core wires 202 are formed by twisting extra fine aluminum wires, which are thinner than the conventional twisted wires. The core wires 202 are covered with an insulating cover 201 formed of an insulating resin.

The crimp terminal 1 is formed as follows. The metal plate (see FIG. 2(*c*)) is formed of a copper alloy strip which has a reflow tin-plated coat 101 on a surface thereof and has a thickness of 0.25 mm (see FIG. 2) and a width of 31 mm (FAS680H, produced by Furukawa Electric Co., Ltd.). The metal plate 100 is bent to have a three-dimensional shape. The box section 2 is formed of an inverted hollow quadrangular prism. The box section 2 accommodates the contact piece 2 which is bent rearward in the longitudinal direction X and has a contact convex section 2*b*, which is to be in contact with the male tab of the male terminal to be inserted.

As shown in FIG. 1(*b*), the wire barrel section 10 in a pre-pressure-bonding state includes a barrel bottom section 11 and wire barrel pieces 12 extending in oblique outer upper directions from both sides of the barrel bottom section 11 in a width direction Y. The wire barrel section 10 is U-shaped when seen in a rear view. Similarly, the insulation barrel section 15 in a pre-pressure-bonding state includes a barrel bottom section 17 and insulation barrel pieces 16 extending in oblique outer upper directions from both sides of the barrel bottom section 17 in the width direction Y. The insulation barrel section 15 is U-shaped when seen in a rear view.

Inner surfaces of the first transition 18 and the second transition 20 formed of the metal plate 100 are respectively covered with resin cover sections 20 (21, 22) (see FIG. 2(*c*)).

In more detail, the first resin cover section 21 for covering the inner surface of the first transition 18 continuously covers an area from a rear end portion of the box section 2 to a front end portion of the wire barrel section 10 including the inner surface of the first transition 18. Similarly, the second resin cover section 22 for covering the inner surface of the second transition 19 continuously covers an area from a rear end portion of the wire barrel section 10 to a front end portion of the insulation barrel section 15 including the inner surface of the second transition 19.

An amount of the first resin cover section 21 which bites into the box section 2 is represented as a first biting amount L1, and an amount of the first resin cover section 21 which bites into the wire barrel section 10 is represented as a second biting amount L2. An amount of the second resin cover section 22 which bites into the wire barrel section 10 is represented as a third biting amount L3. In this example, the first biting amount L1 of the first resin cover section 21 is 0.

The resin cover sections 20 are formed by applying polyamide in stripes.

In a pre-pressure bonding state, the crimp terminal 1 and the insulated wire 200 each having the above-described structure are located as shown in FIG. 1(*b*), and are pressure-bonded to each other by use of a pressure-bonding applicator (not shown). As a result, as shown in FIG. 1(*c*), the connection structural body 1*a*, in which the wire barrel section 10 pressure-bonds the core wires 202 and thus the crimp terminal 1 is attached to the insulated wire 200, is obtained.

Now, a method for forming the resin cover sections 20 on the copper alloy strip which is formed into the metal plate 200 will be described.

As described above, for forming the crimp terminal 1, the copper alloy strip is punched into a shape of the crimp terminal 1 to form a reel as shown in FIG. 3(*a*), the reel is bent, and the resin cover sections 20 are removed from the reel. Thus, the crimp terminal 1 is formed. The resin cover sections 20 (21, 22) are formed on the copper alloy strip before the reel is formed.

In more detail, the metal plate 100 is treated with electrolytic grease removal, washing with an acid, washing with water, and drying in this order. A varnish (solid content: about 30%) of a polyamideimide (PAI) solution containing N-methyl 2-pyrrolidone as a solvent is applied to prescribed positions of the metal plate 100 in stripes as shown in FIG. 3(*a*), such that the post-sintering cover thickness t will be 10 μm (±1 μm), by use of a slit die coater (produced by Itochu Sanki Kabushiki Kaisha). Next, the resultant plate is treated with prescribed heating, and cured while the solvent is dried. As a result, the resin cover sections 20 are obtained.

In this manner, the connection structural body 1*a* having a high durability, in which no galvanic corrosion occurs while the conducting performance is guaranteed, can be produced. In more detail, different metal materials, for example, the core wires 202 formed of aluminum electric wires and the metal plate 100 formed of a copper alloy have different standard electrode potentials. Therefore, when these metal materials are put into contact with each other and an electrolyte solution (water) is attached thereto, a corrosion current flows between a metal material having a high ionization tendency (metal material having a low potential; in this example, aluminum used to form the core wires 202) and a metal material having a low ionization tendency (metal material having a high potential; in this example, copper alloy used to form the metal plate 100). As a result, the metal material having a low potential becomes metal ions, is dissolved in the solution, and is corroded. This is called "galvanic corrosion".

However, in the connection structural body 1*a* using the crimp terminal 1, the metal plate 100 formed of a copper alloy, which has a high potential, is partially covered with the resin cover sections 20. Therefore, an area of the metal plate 100 which is exposed to the core wires 202 formed of aluminum, which has a low potential, is reduced. In addition, the resin cover sections 20 are formed on the inner surfaces of the first transition 18 and the second transition 19, on which the metal plate 100 used to form the crimp terminal 1 and the core wires 202 are in contact with each other. For these reasons, galvanic corrosion can be prevented.

In order to examine whether or not the effect of preventing galvanic corrosion while guaranteeing the conducting performance is sufficiently provided by the resin cover sections 20 to the connection structural body 1*a*, an effect confirming test was performed with the positions, number and width of the resin cover sections 20 being varied (hereinafter, this test will be referred to as the "first effect confirming test"). The results are shown in Table 1.

TABLE 1

| | No. | Resin cover position | Example/ comparative example/ conventional example | Resin cover ratio of strip Resin width ÷ strip width Total of front and rear surfaces | Total biting length of resin into wire barrel [mm] | Biting length of resin into wire barrel (one side) [mm] | Biting ratio of resin into wire barrel |
|---|---|---|---|---|---|---|---|
| 2.3 II female | 101 | Cover ratio: | Example | 0.13 | 0.0 | 0.0 | 0.00 |
| | 102 | minimum | Example | 0.15 | 1.5 | 0.75 | 0.50 |
| | 103 | | Example | 0.17 | 2.0 | 1.0 | 0.67 |
| | 104 | Cover ratio: | Example | 0.33 | 0.2 | 0.1 | 0.07 |
| | 105 | small | Example | 0.35 | 0.7 | 0.35 | 0.23 |
| | 106 | | Example | 0.37 | 1.9 | 0.95 | 0.63 |
| | 107 | Tip of box not | Example | 0.57 | 0.3 | 0.2 | 0.10 |
| | 108 | covered | Example | 0.59 | 0.9 | 0.45 | 0.30 |
| | 109 | | Example | 0.61 | 2.4 | 1.2 | 0.80 |
| | 110 | Cover ratio: | Example | 0.79 | 0.5 | 0.25 | 0.17 |
| | 111 | maximum | Example | 0.81 | 1.0 | 0.5 | 0.33 |
| | 112 | | Example | 0.83 | 1.8 | 0.9 | 0.60 |
| | 113 | Cover ratio: | Example | 0.64 | 0.0 | 0.0 | 0.00 |

TABLE 1-continued

| | | | | | | | |
|---|---|---|---|---|---|---|---|
| | 114 | large; Al wire area not covered | Example | 0.44 | 0.0 | 0.0 | 0.00 |
| | 121 | Inner surface of wire barrel covered | Com. Ex. | 0.84 | 2.8 | 1.4 | 0.93 |
| | 122 | | Com. Ex. | 0.19 | 2.7 | 1.35 | 0.90 |
| | 123 | Cover ratio: small | Com. Ex. | 0.11 | 0.0 | 0.0 | 0.00 |
| | 124 | | Com. Ex. | 0.08 | 0.0 | 0.0 | 0.00 |
| | 130 | No resin | Con. Ex. | 0.00 | | | |
| 0.64 II | 201 | Cover ratio: minimum | Example | 0.12 | 0.2 | 0.1 | 0.07 |
| | 202 | | Example | 0.15 | 1.0 | 0.50 | 0.34 |
| | 203 | | Example | 0.17 | 2.0 | 1.0 | 0.69 |
| | 204 | Cover ratio: small | Example | 0.29 | 0.0 | 0.0 | 0.00 |
| | 205 | | Example | 0.31 | 0.8 | 0.40 | 0.28 |
| | 206 | | Example | 0.34 | 2.2 | 1.10 | 0.76 |
| | 207 | Tip of box not covered | Example | 0.57 | 0.3 | 0.2 | 0.10 |
| | 208 | | Example | 0.59 | 1.4 | 0.70 | 0.48 |
| | 209 | | Example | 0.62 | 2.4 | 1.2 | 0.83 |
| | 210 | Cover ratio: maximum | Example | 0.83 | 0.5 | 0.25 | 0.17 |
| | 211 | | Example | 0.86 | 1.0 | 0.5 | 0.34 |
| | 212 | | Example | 0.88 | 1.8 | 0.9 | 0.62 |
| | 213 | Cover ratio: large; Al wire area not covered | Example | 0.75 | 0.0 | 0.0 | 0.00 |
| | 214 | | Example | 0.49 | 0.0 | 0.0 | 0.00 |
| | 221 | Inner surface of wire barrel covered | Com. Ex. | 0.90 | 2.8 | 1.4 | 0.97 |
| | 222 | | Com. Ex. | 0.19 | 2.7 | 1.35 | 0.93 |
| | 223 | Cover ratio: small | Com. Ex. | 0.11 | 0.0 | 0.0 | 0.00 |
| | 224 | | Com. Ex. | 0.09 | 0.0 | 0.0 | 0.00 |
| | 230 | No resin | Con. Ex. | 0.00 | | | |

| | | Post-punching-out resin cover ratio Resin area size ÷ total surface area | Initial characteristics of connection structural body | | | Corrosion after corrosion test | |
|---|---|---|---|---|---|---|---|
| | No. | of crimp terminal (including end surfaces) | Punched-out part | Bent part | Initial resistance of wire barrel | Resistance increasing value of wire barrel | Degree of corrosion of core wires |
| 2.3 II female | 101 | 0.11 | ○ | ○ | ◎ | ○ | Δ |
| | 102 | 0.13 | ◎ | ○ | ◎ | ◎ | ○ |
| | 103 | 0.15 | ◎ | ○ | ○ | ◎ | ○ |
| | 104 | 0.29 | ○ | ○ | ◎ | ○ | Δ |
| | 105 | 0.30 | ◎ | ○ | ◎ | ◎ | ○ |
| | 106 | 0.33 | ◎ | ○ | ○ | ◎ | ○ |
| | 107 | 0.60 | ◎ | ○ | ◎ | ○ | Δ |
| | 108 | 0.61 | ◎ | ○ | ◎ | ◎ | ○ |
| | 109 | 0.64 | ◎ | ○ | ○ | ◎ | ○ |
| | 110 | 0.67 | ◎ | ○ | ◎ | ○ | ○ |
| | 111 | 0.69 | ◎ | ○ | ◎ | ◎ | ○ |
| | 112 | 0.71 | ◎ | ○ | ○ | ◎ | ○ |
| | 113 | 0.61 | X | ○ | ◎ | ○ | Δ |
| | 114 | 0.54 | X | ○ | ◎ | ○ | Δ |
| | 121 | 0.73 | ◎ | ○ | X | Not tested | |
| | 122 | 0.17 | ◎ | ○ | X | Not tested | |
| | 123 | 0.09 | ◎ | ○ | ◎ | X | X |
| | 124 | 0.08 | ◎ | ○ | ◎ | X | X |
| | 130 | 0.00 | | | ◎ | X | X |
| 0.64 II | 201 | 0.10 | ○ | ○ | ◎ | ○ | Δ |
| | 202 | 0.11 | ◎ | ○ | ◎ | ◎ | ○ |
| | 203 | 0.14 | ◎ | ○ | ○ | ◎ | ○ |
| | 204 | 0.25 | ○ | ○ | ◎ | ○ | Δ |
| | 205 | 0.28 | ◎ | ○ | ◎ | ◎ | ○ |
| | 206 | 0.31 | ◎ | ○ | ○ | ◎ | ○ |
| | 207 | 0.64 | ◎ | ○ | ◎ | ○ | Δ |
| | 208 | 0.67 | ◎ | ○ | ◎ | ◎ | ○ |
| | 209 | 0.70 | ◎ | ○ | ○ | ◎ | ○ |
| | 210 | 0.70 | ◎ | ○ | ◎ | ○ | ○ |
| | 211 | 0.73 | ◎ | ○ | ◎ | ◎ | ○ |
| | 212 | 0.76 | ◎ | ○ | ○ | ◎ | ○ |
| | 213 | 0.63 | ◎ | ○ | ◎ | ○ | Δ |
| | 214 | 0.60 | ◎ | ○ | ◎ | ○ | Δ |
| | 221 | 0.78 | ◎ | ○ | X | Not tested | |
| | 222 | 0.16 | ◎ | ○ | X | Not tested | |

TABLE 1-continued

| | | | | | | |
|---|---|---|---|---|---|---|
| 223 | 0.07 | ◎ | ○ | ◎ | X | X |
| 224 | 0.06 | ◎ | ○ | ◎ | X | X |
| 230 | 0.00 | | | ◎ | X | X |

Com. Ex.: Comparative example
Con. Ex.: Conventional example

For the first effect confirming test, as shown in Table 1, 2.3II female terminals Nos. 101 through 144 were produced. In each of Nos. 101 through 103, as shown in FIGS. 1 through 3, the first resin cover section 21 for covering the inner surface of the first transition 18 (top surface of the metal plate 100 in FIG. 2(*c*)) and the second resin cover section 22 for covering the inner surface of the second transition 19 were formed. In more detail, in No. 101, the total biting length L, i.e., the sum of the second biting amount L2 and the third biting amount L3, was 0; namely, the resin cover sections 20 were formed only on the inner surfaces of the first transition 18 and the second transition 19. In No. 102, the second biting amount L2 and the third biting amount L3 into the wire barrel section 10 were approximately equal to each other, and the total biting length L was 1.5 mm. In No. 103, the second biting amount L2 and the third biting amount L3 into the wire barrel section 10 were more than those in No. 102, and the total biting length L was 2.0 mm.

In each of Nos. 104 through 106, as shown in FIGS. 4 through 6, a third resin cover section 23 for covering an outer surface of the crimp terminal 1 (bottom surface of the metal plate 100 in FIG. 6(*c*)) was formed continuously from a front end of the first resin cover section 21 to a rear end of the second resin cover section 22, in addition to the first resin cover section 21 and the second resin cover section 22.

In more detail, the first resin cover section 21 and the second cover section 22 were formed such that the total biting length L would be 0.2 mm in No. 104, 0.7 mm in No. 105, and 1.9 mm in No. 106.

In each of Nos. 107 through 109, as shown in FIGS. 7 through 9, the second resin cover section 22, which was substantially the same as that of Nos. 104 through 106, was formed. On the inner surface of the first transition 18, a first resin cover section 21*a* was formed from the rear end portion of the box section 2 to the front end portion of the wire barrel section 10. The inside of the box section 2 was bitten into by a front end of the first resin cover section 21*a*.

In addition, a third resin cover section 23*a* was formed on the outer surface of the crimp terminal 1 continuously from a rear end of the contact convex section 2*b* of the pre-bending contact piece 2*a* to a rear end of the second resin cover section 22. The first resin cover section 21*a* and the second resin cover section 22 were formed such that the total biting length L would be 0.3 mm in No. 107, 0.9 mm in No. 108, and 2.4 mm in No. 109.

In each of Nos. 110 through 112, as shown in FIGS. 10 through 12, the second resin cover section 22, which was substantially the same as that of Nos. 104 through 106, and the first resin cover section 21*a* and the third resin cover section 23*a* of Nos. 107 through 109, were formed. In addition, as shown in FIGS. 11(*b*), 12(*a*) and 12(*b*), a fourth resin cover section 24 was formed on the top surface of the metal plate 100, which would become an inner surface of the contact piece 2*a*, forward to the box section 2. As shown in FIGS. 12(*b*) and (*c*), a fifth resin cover section 25 was formed on the bottom surface of the metal plate 100, which would become an outer surface of the contact piece 2*a*, forward to the contact convex section 2*b*.

The first resin cover section 21*a* and the second resin cover section 22 were formed such that the total biting length L would be 0.5 mm in No. 110, 1.0 mm in No. 111, and 1.8 mm in No. 112.

Although not shown, in No. 113, as compared with No. 112, only the first biting amount L1 of the first resin cover section 21*a* was left and the part of the first resin cover section 21*a* rearward to the first biting amount L1 was removed. Although not shown like No. 113, in No. 114, as compared with Nos. 110 through 112, the fourth resin cover section 24 and the fifth resin cover section 25 were removed. In No. 114 and No. 115, the total biting length was 0.

By contrast, comparative examples Nos. 121 and 122 were produced. In Nos. 121 and 122, the inner surface of the wire barrel section 10 of No. 112 and No. 103 was entirely covered with a resin, respectively. Other comparative examples Nos. 123 and 124 were produced. In Nos. 123 and 124, the width (length in the longitudinal direction X) of the resin cover sections 20 was narrower than in No. 101. Conventional example No. 130 was produced. In No. 130, no resin cover section 20 was formed. In addition, 0.64II terminals Nos. 201 through 230 were produced. Nos. 201 through 230 were substantially the same examples and comparative and conventional examples as 2.3II female terminals No. 101 through 130.

The first effect confirming test performed on the crimp terminal 1*a* and the connection structural body 1*a* including any of the above-described various resin cover sections 20 will be described below in detail.

First, the resin cover sections 20 were formed on the copper alloy strip, and the copper alloy strip with the resin cover sections 20 were plated with tin by electroplating by use of an electroplating bath, and treated with reflow at 700° C. for 5 seconds. As a result, a glossy tin-plated coat 101 was formed on the metal plate 100. For example, as shown in FIGS. 3(*a*) and 3(*c*), the metal plate 100 was punched out into a shape of the crimp terminal and bent. As a result, the crimp terminal 1 was formed as a 2.3II female terminal (0.64II female terminal). The produced crimp terminal 1 was evaluated for the punch-out processability and the bending processability. The evaluations for both of the processabilities were made on three crimp terminals 1 sampled out for each standard.

The punch-out processability was evaluated as follows. The crimp terminal was immersed in an aqueous solution containing red ink dissolved therein, and the width of a delaminated part of the resin cover section 20 at the end of the punched-out part was examined by observation by use of an optical microscope. However, the crimp terminal 1 was three-dimensional and thus it was impossible to examine the part not viewed by the optical microscope. Only the part which was observed by the optical microscope was examined. The crimp terminal in which the maximum width of the delaminated part was less than 5 μm was evaluated as "◎", the crimp terminal in which the maximum width of the delaminated part was 5 μm or more and less than 10 μm was evaluated as "○", and the crimp terminal in which the maximum width of the delaminated part was more than 10 μm was evaluated as "X". The bending processability was evaluated as follows. It was observed by an optical stereo microscope whether the resin was delaminated, wrinkled, or cracked in the inside and outside of the bent part. The crimp terminal in a good state with no defect was evaluated as "○", and the crimp terminal with delamination, wrinkles or cracks was evaluated as "X". In Nos. 101, 102 and 103, the resin cover section 20 was only formed on the inside of the bent part and was not formed on the outside of the bent part. Therefore, only the inside of the bent part was evaluated for these crimp terminals.

Next, the core wires 202 formed of aluminum electric wires (composition of the aluminum electric wires: ECAI, 11 wires being twisted) having a conductor cross-sectional area size of 0.75 $mm^2$ and a length of 11 cm were pressure-bonded and thus attached to the produced crimp terminal 1 to form the connection structural body 1*a*. The other end of the core wires pressure-bonded to the crimp terminal 1 was stripped of the cover 201 by a length of 10 mm and immersed in a solder bath for aluminum (produced by Nihon Almit Co., Ltd.; T235, using flux) to solder the surface of the core wires 202. Thus, the resistance with the contact with the probe at the time of measurement of the electric resistance was minimized.

The initial resistance measurement and the corrosion test were performed on 20 samples for each standard. The resistance increasing value and the corrosion state were measured and observed on all of the samples.

The initial resistance was measured by use of a resistance meter (ACmΩHiTESTER3560; produced by Hioki E.E. Corporation) by a 4-terminal method. The wire barrel section 10 side of the box section 2 was set as a positive electrode, and the other end of the core wires 202 stripped of the cover was set as a negative electrode. The measured resistance value was considered to be a total of the resistances of the pressure-bonding points of the core wires 202 as the aluminum electric wires, of the crimp terminal 1, and of the wire barrel section 10. Since the resistance of the core wires 202 was not ignorable, the resistance of the core wires 202 was subtracted from the measured resistance value and the resultant value was set as the initial resistance of the wire barrel section 10. When all of the 20 samples had an initial resistance of less than 10 mΩ, the connection structural body was evaluated as "◎". When three or less of the 20 samples had an initial resistance of 1 mΩ or more and less than 3 mΩ and the remaining samples had an initial resistance of less than 1 mΩ, the connection structural body was evaluated as "○". When more than three of the 20 samples had an initial resistance of 1 mΩ or more and less than 3 mΩ and the remaining sample(s) had an initial resistance of less than 1 mΩ, the connection structural body was evaluated as "Δ". When at least one of the 20 samples had an initial resistance of 3 mΩ or more, the connection structural body was evaluated as "X".

The corrosion test was performed as follows. The other end of the core wires 202 stripped of the insulating cover was covered with a tube formed of Teflon (registered trademark) (Teflon Tube ((registered trademark)) produced by Nichias Corporation). The Teflon tube was fixed by a PTFE tape to be water-proof. Then, a salt spray test defined by JISZ2371 (spraying 5% by weight of saline solution at 35° C. at a prescribed pressure) was performed for 96 hours. After the test, the water-proof tape was removed, and the resistance was measured in substantially the same manner as for the initial resistance. The initial resistance value was subtracted from the measured value regarding each sample. Thus, the resistance increasing value of the pressure-bonding section after the spraying was calculated.

When all of the 20 samples had a resistance increasing value of less than 1 mΩ, the connection structural body was evaluated as "◎". When three or less of the 20 samples had a resistance increasing value of 1 mΩ or more and less than 3 mΩ and the remaining samples had a resistance increasing value of less than 1 mΩ, the connection structural body was evaluated as "○". When more than three and 19 or less of the 20 samples had a resistance increasing value of 1 mΩ or more and less than 3 mΩ and the remaining sample(s) had a resistance increasing value of less than 1 mΩ, or when all of the 20 samples had a resistance increasing value of 1 mΩ or more and less than 3 mΩ, the connection structural body was evaluated as "Δ". When at least one of the 20 samples had a resistance increasing value of 3 mΩ or more and less than 10 mΩ, the connection structural body was evaluated as "∇". When at least one of the 20 samples had a resistance increasing value of 10 mΩ or more, the connection structural body was evaluated as "X".

The degree of corrosion was observed from the surface. When no corrosion was observed in the core wires 202, the connection structural body was evaluated as "◎". When corrosion of the core wires 202 was observed from the surface, three, at the maximum, of the corroded core wires 202 were drawn out, and a cross-section of each core wire 202 at or in the vicinity of the center of the wire barrel section was polished and observed by an optical microscope. When all the observed core wires 202 completely remained, the connection structural body was evaluated as "○". When at least one of the observed conductors, namely, the observed core wires 202, was partially lost due to corrosion, the connection structural body was evaluated as "Δ". When at least one of the observed conductors, namely, the observed core wires 202 in the wire barrel section, was mostly or entirely lost due to corrosion, the connection structural body was evaluated as "X".

In Table 1, the "resin cover ratio of the strip" is obtained as follows. The total length of the resin cover sections 20 is divided by twice the length, in the longitudinal direction X, of an area of the copper alloy strip which is punched out into a shape of the crimp terminal. For example, for Nos. 101 through 103 shown in FIG. 2, the resin cover ratio of the strip=(y1+y2)÷(x+x). For Nos. 104 through 106 shown in FIG. 4, the resin cover ratio of the strip=(y1+y2+y3)÷(x+x).

In Table 1, the "post-punching-out resin cover ratio" is obtained as a result of converting the cover ratio in consideration of the shape of the terminal and also in consideration of the post-punching-out end surfaces of the copper alloy strip. The post-punching-out resin cover ratio is a value obtained by dividing the total surface area size of the resin cover sections 20 of the terminal by the total surface area size of the wire barrel section 10 after the copper alloy strip is punched out into the shape of the terminal.

As a result of the above-described tests, regarding Nos. 101 through 114 and 201 through 214 having a resin cover ratio of the strip of 0.12 or more (or a cover ratio of the terminal of 0.10 or more), it has been confirmed that all the 20 samples have a resistance increasing value of less that 1 mΩ after the corrosion test, or that three or less of the 20 samples have a resistance increasing value of 1 mΩ or more and less than 3 mΩ after the corrosion test.

Also regarding Nos. 101 through 114 and 201 through 214 having a resin cover ratio of the strip of 0.12 or more (or a cover ratio of the terminal of 0.10 or more), after the corrosion test, corrosion was observed in all the core wires 202 from the surface. However, when the cross-section of the wire barrel section 10 was observed, the core wires 202 completely remained or were merely partially lost due to corrosion. Thus, it has been confirmed that although corrosion is observed partially, the degree of increase of the electric resistance is small.

By contrast, regarding comparative examples Nos. 121, 122, 221 and 222 having a resin cover ratio of the strip of 0.12 or more (or a cover ratio of the terminal of 0.10 or more) but having the resin cover section 20 on the entire inner surface of the wire barrel section 10, the samples partially had a high initial resistance of the wire barrel section 10 exceeding 3 mΩ. Thus, it has been confirmed that these comparative examples are inappropriate for a connection structural body.

The biting ratio of the resin cover section 20 is a value obtained as a result of dividing the total biting length L, obtained when the inside of the wire barrel section 10 was bitten into by the resin cover section 20, by the wire barrel length L (see FIG. 2), namely, the length of the wire barrel section 10 in the longitudinal direction X. It has been confirmed that when the biting ratio of the resin cover section 20 is 0.2 or more, all the 0 samples have a superb resisting increasing value at less than 1 mΩ after the corrosion test. It has also been confirmed that when the biting ratio of the resin cover section 20 is 0.6 or less, the initial resistance is sufficiently low.

The resin cover sections 20 provided in narrow stripes tended to be delaminated at many sites in the punched-out part and the bent part. However, it has been confirmed that such delamination has no influence on the corrosion or resistance increase after the salt spray test. However, a crimp terminal mounted on a vehicle needs to be durable in order to be reliable for a long time. The salt spraying is presumed to have been performed in order to make a state of the crimp terminal, which would be otherwise realized after long-time use, in an accelerated manner. Nonetheless, a crimp terminal in which the resin cover sections 20 are not delaminated is more reliable.

As a result of the first effect confirming test performed on the crimp terminal 1 and the connection structural body 1*a* including any of various types of resin cover sections 20, the following been confirmed. A crimp terminal 1 and a connection structural body 1*a* having a resin cover ratio of the metal plate of 0.12 or more (or having a cover ratio of the terminal of 0.10 or more), having a resin biting ratio of 0.2 or more and 0.6 or less, and not having the resin cover section 20 on the entire inner surface of the wire barrel section 10 provide an effect of preventing galvanic corrosion while guaranteeing the conducting performance.

In the above-described first effect confirming test, the resin cover section 20 was formed by applying polyamideimide (PAI) on a copper alloy strip having a thickness of 0.25 mm and a width of 31 mm (FAS680H, produced by Furukawa Electric Co., Ltd.). Also on the resin cover section 20 formed as follows (2.3II female terminals Nos. 301 through 324, 0.64II female terminals Nos. 401 through 424), the above-described effect confirming test was performed (hereinafter, referred to as the "second effect confirming test"). As the metal plate 100, a brass strip having a thickness of 0.25 mm and a width of 31 mm was used. An ultraviolet-curable resin (acrylate-based resin, 3052C produced by ThreeBond Co., Ltd.) was applied to the metal plate 100 such that the cover thickness t would be 10 μm (±1 μm) and cured. The results of the second effect confirming test are shown in Table 2.

TABLE 2

| | No. | Resin cover position | Example/ comparative example/ conventional example | Resin cover ratio of strip Resin width ÷ strip width Total of front and rear surfaces | Total biting length of resin into wire barrel [mm] | Biting length of resin into wire barrel (one side) [mm] | Biting ratio of resin into wire barrel |
|---|---|---|---|---|---|---|---|
| 2.3 II | 301 | Cover ratio: | Example | 0.13 | 0.0 | 0.0 | 0.00 |
| female | 302 | minimum | Example | 0.15 | 1.5 | 0.75 | 0.50 |
| | 303 | | Example | 0.17 | 2.0 | 1.0 | 0.67 |
| | 304 | Cover ratio: | Example | 0.33 | 0.2 | 0.1 | 0.07 |
| | 305 | small | Example | 0.35 | 0.7 | 0.35 | 0.23 |
| | 306 | | Example | 0.37 | 1.9 | 0.95 | 0.63 |
| | 307 | Tip of box not | Example | 0.57 | 0.3 | 0.2 | 0.10 |
| | 308 | covered | Example | 0.59 | 0.9 | 0.45 | 0.30 |
| | 309 | | Example | 0.61 | 2.4 | 1.2 | 0.80 |
| | 310 | Cover ratio: | Example | 0.79 | 0.5 | 0.25 | 0.17 |
| | 311 | maximum | Example | 0.81 | 1.0 | 0.5 | 0.33 |
| | 312 | | Example | 0.83 | 1.8 | 0.9 | 0.60 |
| | 313 | Cover ratio: | Example | 0.64 | 0.0 | 0.0 | 0.00 |
| | 314 | large; Al wire area not covered | Example | 0.44 | 0.0 | 0.0 | 0.00 |
| | 321 | Inner surface of | Com. Ex. | 0.84 | 2.8 | 1.4 | 0.93 |
| | 322 | wire barrel covered | Com. Ex. | 0.19 | 2.7 | 1.35 | 0.90 |
| | 323 | Cover ratio: | Com. Ex. | 0.11 | 0.0 | 0.0 | 0.00 |
| | 324 | small | Com. Ex. | 0.08 | 0.0 | 0.0 | 0.00 |
| 0.64 II | 401 | Cover ratio: | Example | 0.12 | 0.2 | 0.1 | 0.07 |
| female | 402 | minimum | Example | 0.15 | 1.0 | 0.50 | 0.34 |
| | 403 | | Example | 0.17 | 2.0 | 1.0 | 0.69 |
| | 404 | Cover ratio: | Example | 0.29 | 0.0 | 0.0 | 0.00 |
| | 405 | small | Example | 0.31 | 0.8 | 0.40 | 0.28 |
| | 406 | | Example | 0.34 | 2.2 | 1.10 | 0.76 |
| | 407 | Tip of box not | Example | 0.57 | 0.3 | 0.2 | 0.10 |
| | 408 | covered | Example | 0.59 | 1.4 | 0.70 | 0.48 |

TABLE 2-continued

| | | | | | | |
|---|---|---|---|---|---|---|
| 409 | | Example | 0.62 | 2.4 | 1.2 | 0.83 |
| 410 | Cover ratio: | Example | 0.83 | 0.5 | 0.25 | 0.17 |
| 411 | maximum | Example | 0.86 | 1.0 | 0.5 | 0.34 |
| 412 | | Example | 0.88 | 1.8 | 0.9 | 0.62 |
| 413 | Cover ratio: | Example | 0.75 | 0.0 | 0.0 | 0.00 |
| 414 | large; Al wire area not covered | Example | 0.49 | 0.0 | 0.0 | 0.00 |
| 421 | Inner surface of | Com. Ex. | 0.90 | 2.8 | 1.4 | 0.97 |
| 422 | wire barrel covered | Com. Ex. | 0.19 | 2.7 | 1.35 | 0.93 |
| 423 | Cover ratio: | Com. Ex. | 0.11 | 0.0 | 0.0 | 0.00 |
| 424 | small | Com. Ex. | 0.09 | 0.0 | 0.0 | 0.00 |

| | | Post-punching-out resin cover ratio Resin area size ÷ total surface area | Initial characteristics of connection structural body | | | Corrosion after salt spraying | |
|---|---|---|---|---|---|---|---|
| | No. | of crimp terminal (including end surfaces) | Punched-out part | Bent part | Initial resistance of wire barrel | Resistance increasing value of wire barrel | Degree of corrosion of core wires |
| 2.3 II female | 301 | 0.11 | ○ | ○ | ◎ | ○ | Δ |
| | 302 | 0.13 | ○ | ○ | ◎ | ◎ | ○ |
| | 303 | 0.15 | ◎ | ○ | ○ | ◎ | ○ |
| | 304 | 0.29 | ○ | ○ | ◎ | ○ | Δ |
| | 305 | 0.30 | ○ | ○ | ◎ | ◎ | ○ |
| | 306 | 0.33 | ◎ | ○ | ○ | ◎ | ○ |
| | 307 | 0.60 | ◎ | ○ | ◎ | ○ | Δ |
| | 308 | 0.61 | ◎ | ○ | ◎ | ◎ | ○ |
| | 309 | 0.64 | ◎ | ○ | ○ | ◎ | ○ |
| | 310 | 0.67 | ◎ | ○ | ◎ | ○ | ○ |
| | 311 | 0.69 | ◎ | ○ | ◎ | ◎ | ○ |
| | 312 | 0.71 | ◎ | ○ | ○ | ◎ | ○ |
| | 313 | 0.61 | X | ○ | ◎ | ○ | Δ |
| | 314 | 0.54 | X | ○ | ◎ | ○ | Δ |
| | 321 | 0.73 | ◎ | ○ | X | Not tested | |
| | 322 | 0.17 | ◎ | ○ | X | Not tested | |
| | 323 | 0.09 | ◎ | ○ | ◎ | X | X |
| | 324 | 0.08 | ◎ | ○ | ◎ | X | X |
| 0.64 II female | 401 | 0.08 | ○ | ○ | ◎ | ○ | Δ |
| | 402 | 0.11 | ○ | ○ | ◎ | ◎ | ○ |
| | 403 | 0.14 | ◎ | ○ | ○ | ◎ | ○ |
| | 404 | 0.25 | ○ | ○ | ◎ | ○ | Δ |
| | 405 | 0.28 | ○ | ○ | ◎ | ◎ | ○ |
| | 406 | 0.31 | ◎ | ○ | ○ | ◎ | ○ |
| | 407 | 0.64 | ◎ | ○ | ◎ | ○ | Δ |
| | 408 | 0.67 | ◎ | ○ | ◎ | ◎ | ○ |
| | 409 | 0.70 | ◎ | ○ | ○ | ◎ | ○ |
| | 410 | 0.70 | ◎ | ○ | ◎ | ○ | ○ |
| | 411 | 0.73 | ◎ | ○ | ◎ | ◎ | ○ |
| | 412 | 0.76 | ◎ | ○ | ○ | ◎ | ○ |
| | 413 | 0.63 | ○ | ○ | ◎ | ○ | Δ |
| | 414 | 0.60 | ◎ | ○ | ◎ | ○ | Δ |
| | 421 | 0.78 | ◎ | ○ | X | Not tested | |
| | 422 | 0.16 | ◎ | ○ | X | Not tested | |
| | 423 | 0.07 | ◎ | ○ | ◎ | X | X |
| | 424 | 0.06 | ◎ | ○ | ◎ | X | X |

Com. Ex.: Comparative example

As shown in Table 2, it has been confirmed that the results of the second effect confirming test are substantially the same as those of the first effect confirming test described above. From this, it has been confirmed that when a brass strip is used as the metal plate 100 and an ultraviolet-curable resin is used for the resin cover sections 20, the effect of preventing galvanic corrosion while guaranteeing the conducting performance can be provided.

An effect confirming test was performed to examine how the cover thickness t of the resin cover section 20 influences the effect of preventing galvanic corrosion while guaranteeing the conducting performance (hereinafter, this test will be referred to as the "third effect confirming test"). Now, the third effect confirming test will be described.

For the third effect confirming test, the crimp terminals 1 were produced in the same manner as Nos. 102, 112, 202 and 212 used in the first effect confirming test, except that the cover thickness t of the resin cover sections 20 was variously changed in the range of 1 to 50 μm. The third effect confirming test was performed on such crimp terminals 1 in substantially the same manner as the first effect confirming test. The results of the third effect confirming test are shown in Table 3.

TABLE 3

| | No. | Resin cover position | Example/ comparative example/ conventional example | Resin thickness [μm] | Initial resistance of wire barrel | Corrosion after salt spraying: Resistance increasing value of wire barrel | Corrosion after salt spraying: Degree of corrosion of core wires |
|---|---|---|---|---|---|---|---|
| 2.3 II female | 102 | Cover ratio: minimum | Example | 10 | ◎ | ◎ | ○ |
| | 102-1 | | Com. Ex. | 1 | ◎ | ○ | X |
| | 102-2 | | Example | 5 | ◎ | ◎ | ○ |
| | 102-3 | | Example | 20 | ○ | ◎ | ○ |
| | 102-4 | | Example | 30 | ○ | ○ | ○ |
| | 102-5 | | Com. Ex. | 50 | X | Not tested | |
| | 112 | Cover ratio: maximum | Example | 10 | ○ | ◎ | ○ |
| | 112-1 | | Com. Ex. | 1 | ◎ | X | Δ |
| | 112-2 | | Example | 5 | ◎ | ◎ | ○ |
| | 112-3 | | Example | 20 | ○ | ◎ | ○ |
| | 112-4 | | Example | 30 | ○ | ○ | ○ |
| | 112-5 | | Com. Ex. | 50 | X | Not tested | |
| 0.64 II female | 202 | Cover ratio: minimum | Example | 10 | ◎ | ◎ | ○ |
| | 202-1 | | Com. Ex. | 1 | ◎ | ○ | X |
| | 202-2 | | Example | 5 | ◎ | ◎ | ○ |
| | 202-3 | | Example | 20 | ○ | ◎ | ○ |
| | 202-4 | | Example | 30 | ○ | ○ | ○ |
| | 202-5 | | Com. Ex. | 50 | X | Not tested | |
| | 212 | Cover ratio: maximum | Example | 10 | ○ | ◎ | ○ |
| | 212-1 | | Com. Ex. | 1 | ◎ | X | X |
| | 212-2 | | Example | 5 | ◎ | ◎ | ○ |
| | 212-3 | | Example | 20 | ○ | ◎ | ○ |
| | 212-4 | | Example | 30 | ○ | ○ | ○ |
| | 212-5 | | Com. Ex. | 50 | X | Not tested | |

Com. Ex.: Comparative example

As shown in Table 3, it has been confirmed that when the cover thickness t of the resin cover section 20 is 50 μm as in the comparative examples (Nos. 102-5, 112-5, 202-5, 212-5), the initial resistance is high. A conceivable reason for this is that since the cover thickness t of the resin cover section 20 is too large, the contact of the wire barrel section 10 of the crimp terminal 1 and the core wires 202 is inhibited.

By contrast, when the cover thickness t of the resin cover section 20 is 1 μm (Nos. 102-1, 112-1, 202-1, 212-1), the initial resistance is sufficiently low, but the characteristics after the corrosion test are poor. A conceivable reason for this is that when the cover thickness t of the resin cover section 20 is too small, galvanic corrosion of the core wires 202 formed of aluminum electric wires proceeds by the influence of the metal plate 100 formed of a metal material having a high potential.

It has been confirmed that when the cover thickness t of the resin cover section 20 is 5 to 30 μm as in the crimp terminal 1 in this example (Nos. 102-2 through 4, 112-2 through 4, 202-2 through 4, 212-2 through 4), the initial resistance and the characteristics after the corrosion test are both good. From the third effect confirming test, it has been confirmed that a crimp terminal 1 in which the cover thickness t of the resin cover sections 20 is 5 to 30 μm can provide an effect of preventing galvanic corrosion while guaranteeing the conducting performance.

In Example 1 above, the metal plate 100 used to form the crimp terminal 1 is formed of a copper alloy strip provided with the reflow tin-plated coat 101. Alternatively, the reflow tin-plated coat 101 may be used together with a nickel-plated coat.

Alternatively for the crimp terminal 1, the resin cover sections 20 may be formed after the nickel-plated coat is formed. Still alternatively, the resin cover sections 20 may be formed after the nickel-plated coat is formed, and then the reflow tin-plated coat 101 may be formed.

The tin plating is not limited to reflow tin plating, and reflow may not be performed after the electroplating with tin; namely, glossless tin plating may be used.

An effect confirming test for examining the effect of preventing galvanic corrosion while guaranteeing the conducting performance was performed on the crimp terminals 1 produced with the type of plating being varied or the order of plating and formation of the resin cover section 20 being varied (hereinafter, this test will be referred to as the "fourth effect confirming test"). The fourth effect confirming test was performed in the same manner as the first effect confirming test. The results of the fourth effect confirming test are shown in Table 4.

TABLE 4

| | No. | Resin cover position | Example/ comparative example/ conventional example | Initial characteristics of connection structural body: Punched-out part | Initial characteristics of connection structural body: Bent part | Initial characteristics of connection structural body: Initial resistance of wire barrel | Corrosion after salt spraying: Resistance increasing value of wire barrel | Corrosion after salt spraying: Degree of corrosion of core wires | Heat resistance test |
|---|---|---|---|---|---|---|---|---|---|
| 2.3 II female | 102 | Cover ratio: minimum | Example | ◎ | ○ | ◎ | ◎ | ○ | ○ |
| | 102-A | | Example | ◎ | ○ | ◎ | ◎ | ○ | ◎ |
| | 102-B | | Example | ◎ | ○ | ◎ | ◎ | ○ | ◎ |
| | 102-C | | Example | ◎ | ○ | ◎ | ◎ | ○ | ◎ |

TABLE 4-continued

| | No. | Resin cover position | Example/ comparative example/ conventional example | Initial characteristics of connection structural body: Punched-out part | Bent part | Initial resistance of wire barrel | Corrosion after salt spraying: Resistance increasing value of wire barrel | Degree of corrosion of core wires | Heat resistance test |
|---|---|---|---|---|---|---|---|---|---|
| | 102-D | | Com. Ex. | X | X | ◎ | ∇ | X | X |
| | 112 | Cover ratio: maximum | Example | ◎ | ○ | ○ | ◎ | ○ | ○ |
| | 112-A | | Example | ◎ | ○ | ○ | ◎ | ○ | ◎ |
| | 112-B | | Example | ◎ | ○ | ○ | ◎ | ○ | ◎ |
| | 112-C | | Example | ◎ | ○ | ○ | ◎ | ○ | ◎ |
| | 112-D | | Com. Ex. | X | X | ○ | Δ | X | X |
| 0.64 II female | 202 | Cover ratio: minimum | Example | ◎ | ○ | ◎ | ◎ | ○ | ○ |
| | 202-A | | Example | ◎ | ○ | ◎ | ◎ | ○ | ◎ |
| | 202-B | | Example | ◎ | ○ | ◎ | ◎ | ○ | ◎ |
| | 202-C | | Example | ◎ | ○ | ◎ | ◎ | ○ | ◎ |
| | 202-D | | Com. Ex. | X | X | ○ | ∇ | X | X |
| | 212 | Cover ratio: maximum | Example | ◎ | ○ | ○ | ◎ | ○ | ○ |
| | 212-A | | Example | ◎ | ○ | ○ | ◎ | ○ | ◎ |
| | 212-B | | Example | ◎ | ○ | ○ | ◎ | ○ | ◎ |
| | 212-C | | Example | ◎ | ○ | ○ | ◎ | ○ | ◎ |
| | 212-D | | Com. Ex. | X | X | ○ | Δ | X | X |

Com. Ex.: Comparative example

For the fourth effect confirming test, Nos. 102-A, 112-A, 202-A and 212-A (hereinafter, referred to as the "A pattern") were formed as follows. A resin was first applied to a surface of the metal plate 100 which would be the inner surface of a terminal and sintered to form the resin cover sections 20 on the inner surface, and the metal plate 100 provided with the resin cover sections 20 was entirely plated with nickel (1 μm) by electroplating. Then, a resin was applied to a surface of the metal plate 100 which would be an outer surface of the terminal and sintered to form the resin cover sections 20 on the outer surface, and the metal plate 100 was entirely plated with tin (1 μm) by electroplating. The resultant plate was treated with reflow at 700° C. for 5 seconds.

Nos. 102-B, 112-B, 202-B and 212-B (hereinafter, referred to as the "B pattern") were formed as follows. The metal plate 100 was entirely plated with nickel (1 μm) by electroplating. A resin was applied to prescribed positions of both surfaces of the metal plate 100 and sequentially sintered to form the resin cover sections 20. Then, the metal plate 100 was entirely plated with Sn, and treated with reflow.

Nos. 102-C, 112-C, 202-C and 212-C (hereinafter, referred to as the "C pattern") were formed as follows. A resin was applied to both surfaces of the metal plate 100 sequentially and sintered to form the resin cover sections 20. Then, the metal plate 100 was plated with nickel and then with tin, and treated with reflow.

Nos. 102-D, 112-D, 202-D and 212-D (hereinafter, referred to as the "D pattern") were formed as follows. The metal plate 100 was first plated with nickel (1 μm) by electroplating, then plated with tin, and treated with reflow. Then, a resin was applied to both surfaces of the metal plate 100 sequentially and sintered to form the resin cover sections 20.

In Table 4, Nos. 102, 112, 202 and 212 with no alphabetical letter (hereinafter, referred to as the "non-combined plating pattern") were produced by the method described regarding the first effect confirming test. In more detail, first, the resin cover sections 20 were formed on the copper alloy strip, and then the copper alloy strip with the resin cover sections 20 was plated with tin by electroplating in an electroplating bath and treated with reflow. Nickel plating was not used.

The fourth effect confirming test was performed in substantially the same manner as the first effect confirming test, and results were evaluated in substantially the same manner as in the first effect confirming test. In addition, a heat resistance test was performed by leaving the terminals at 140° C. for 10 days. How the resin cover sections 20 deteriorated was examined. The observation was made by use of a stereo microscope. The crimp terminal in which the resin was not conspicuously delaminated or cracked except for small delamination was evaluated as "◎", the crimp terminal in which the delamination from the edge of the resin was as small as less than 10 μm was evaluated as "○", and the crimp terminal in which the depth of delamination from the edge of the resin was as large as more than 10 μm was evaluated as "X".

As a result, as shown in Table 4, it has been confirmed that the corrosion state after the salt spraying is good in the A pattern, B pattern, C pattern and non-combined plating pattern, but is poor in the D pattern. From this, the following has been confirmed. In the case where the nickel-plated coat is used together with the reflow tin-plated coat 101, the method of forming the resin cover sections 20 after the nickel-plated coat and the reflow tin-plated coat 101 are formed (D pattern) does not provide an effect of preventing galvanic corrosion while guaranteeing the conducting performance. The method of forming the reflow tin-plated coat 101 after the resin cover sections 20 are formed (A pattern, B pattern, C pattern and non-combined plating pattern) provides an effect of preventing galvanic corrosion while guaranteeing the conducting performance.

Regarding the method of forming the reflow-tin plated coat 101 after the resin cover sections 20 are formed, the following has also been confirmed. When the nickel-plated coat and the reflow tin-plated coat 101 are used together (A pattern, B pattern, C pattern), a more durable effect of preventing galvanic corrosion is provided than when nickel plating is not used (non-combined plating pattern).

Example 2

Figures 13A, 13B:
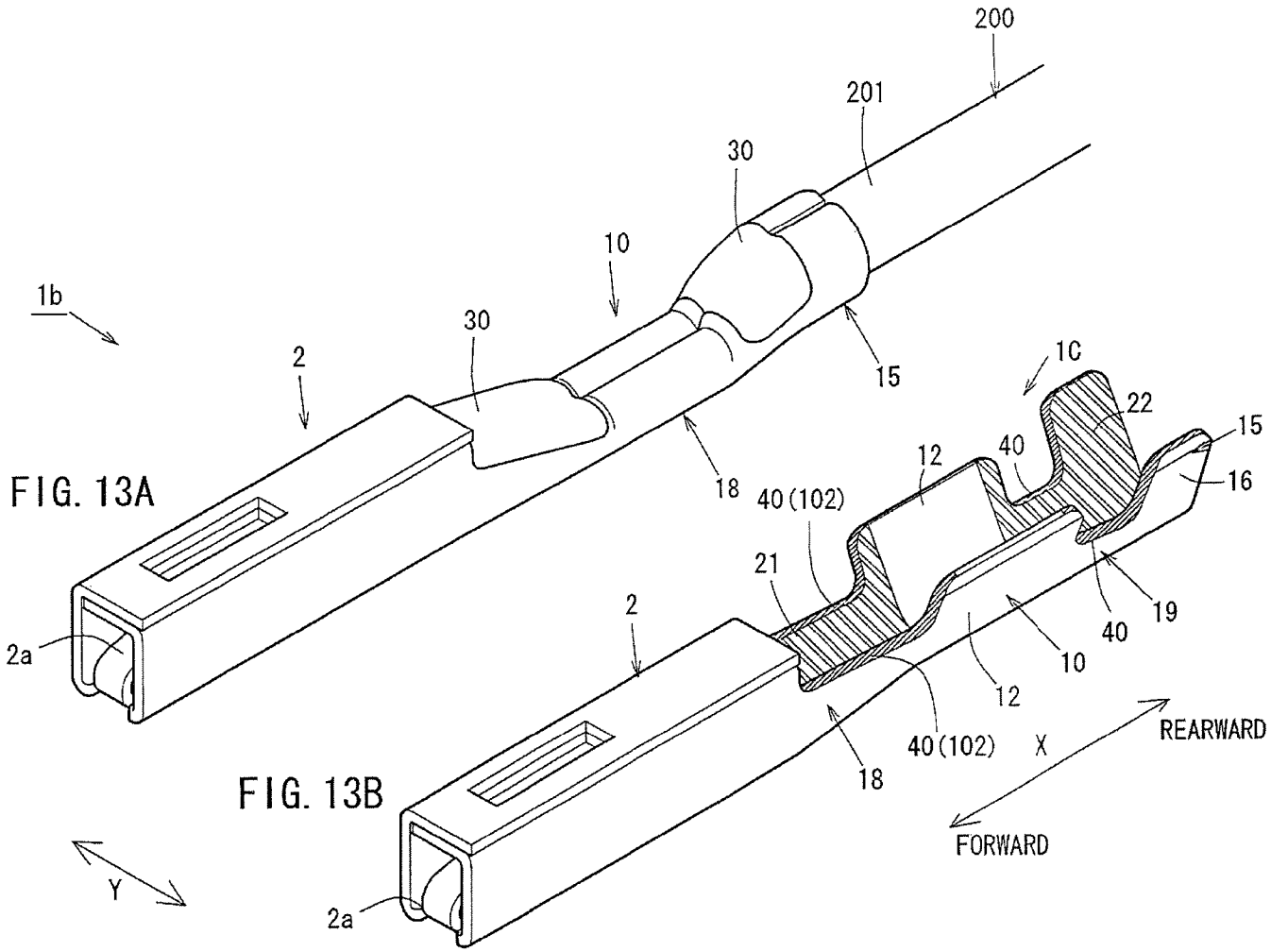
FIG. 13 shows a connection structural body in Example 2 and a crimp terminal in Example 3.

A connection structural body 1*b* in this example includes exposed part resin cover sections 30 as shown in FIG. 13(*a*). The crimp terminal 1 including resin cover sections 20 and the core wires 202 formed of aluminum electric wires are pressure-bonded and thus connected to each other. In this state, exposed parts 202*a* (see FIG. 1(*c*)) of the core wires 202 are covered with a resin from above the first transition 18 and the second transition 19. Such covered parts are the exposed part resin cover sections 30.

The exposed part resin cover sections 30 are formed as follows. The insulated wire 200 is pressure-bonded by the insulation barrel section 15. Then, a photocurable resin is applied so as to cover the exposed parts 202*a*, and irradiated with ultraviolet rays to be cured.

Owing to this, the effect of preventing galvanic corrosion while guaranteeing the conducting performance of the connection structural body 1*b* can be improved.

An effect confirming test was performed on the connection structural body 1*b* to examine the effect of preventing galvanic corrosion while guaranteeing the conducting performance (hereinafter, this test will be referred to as the "fifth effect confirming test"). Now, the fifth effect confirming test will be described.

For the fifth effect confirming test, connection structural bodies 1*b* (Nos. 501, 512, 601, 612) were each produced as follows. The core wires 202 were pressure-bonded to the crimp terminal 1 of each of Nos. 301, 312, 401 and 412 used in the second effect confirming test. The same resin as used for forming the resin cover sections 20 in the second effect confirming test (acrylate-based resin, 3052C produced by ThreeBond Co., Ltd.) was applied to the exposed parts 202*a* of the core wires 202 so as to cover the exposed parts 202*a*, and irradiated with ultraviolet rays to be cured. The opposite end of the insulated wire 200 was treated substantially the same manner as in the first effect confirming test.

As comparative examples, connection structural bodies 1*a* (No. 530, 630) are each formed as follows. The core wires 202 were connected to the crimp terminal 1 with no resin cover section 20, and the exposed parts of the core wires 202 were covered with the exposed part resin cover sections 30 (Nos. 530, 630).

The results of the fifth effect confirming test are shown in Table 5.

As shown in Table 5, it has been found that the electric resistance increasing value and the corrosion state at 96 hours after salt spraying are significantly improved. Regarding the comparative examples (Nos. 530, 630), the following has been confirmed. Slight improvement in the post-salt spraying characteristics is observed as compared with the conventional examples (No. 130, 230) in which the exposed parts 202*a* are not covered with a resin, namely, the exposed part resin cover sections 30 are not provided. However, the performance of Nos. 530 and 630 is lower as compared with the connection structural body 1*b*, in which the crimp terminal 1 including the resin cover sections 20 and the exposed resin cover sections 30 for covering the exposed parts 202s are used. In this manner, it has been confirmed that the effect of preventing galvanic corrosion while guaranteeing the conducting performance can be improved by a structure in which the core wires 202 are pressure-bonded and thus connected to the crimp terminal 1 including the resin cover sections 20 and the exposed parts 202*a* of the core wires 202 are covered with the exposed part resin cover sections 30.

Example 3

An end surface-covered crimp terminal 1' in this example includes, as shown in FIG. 13(*b*), the resin cover sections 20 (21, 22) at prescribed positions and end surface resin cover sections 40 for covering end surfaces 102 of parts of the crimp terminal 1 where the resin cover sections 20 are provided. In FIG. 13(*b*), the crimp terminal 1 (see FIG. 1) includes the first resin cover section 21 and the second resin cover section 22 formed on the inner surfaces of the first transition 18 and the second transition 19, and the end surface resin cover sections 40 are formed on the end surfaces 102 of the parts of the crimp terminal 1 where the resin cover sections 20 are provided.

TABLE 5

| | No. | Resin cover position | Example/ comparative example/ conventional example | Resin cover ratio of strip Resin width ÷ strip width Total of front and rear surfaces | Total biting length of resin into wire barrel [mm] | Biting length of resin into wire barrel (one side) [mm] | Biting ratio of resin into wire barrel | Post-punching-out resin cover ratio Resin area size ÷ total surface area of crimp terminal (including end surfaces) |
|---|---|---|---|---|---|---|---|---|
| 2.3 II female | 501 | Cover ratio: minimum | Example | 0.13 | 0.0 | 0.0 | 0.00 | 0.11 |
| | 512 | | Example | 0.83 | 1.8 | 0.9 | 0.60 | 0.71 |
| | 530 | No resin | Com. Ex. | 0.00 | | | | 0.00 |
| 0.64 II female | 601 | Cover ratio: minimum | Example | 0.12 | 0.2 | 0.1 | 0.07 | 0.08 |
| | 612 | | Example | 0.88 | 1.8 | 0.9 | 0.62 | 0.76 |
| | 630 | No resin | Com. Ex. | 0.00 | | | | 0.00 |

| | | Initial characteristics of connection structural body | | | Corrosion after salt spraying | |
|---|---|---|---|---|---|---|
| | No. | Punched-out part | Bent part | Initial resistance of wire barrel | Resistance increasing value of wire barrel | Degree of corrosion of core wires |
| 2.3 II female | 501 | ○ | ○ | ◎ | ◎ | ◎ |
| | 512 | ◎ | ○ | ○ | ◎ | ◎ |
| | 530 | | | ◎ | ∇ | Δ |
| 0.64 II female | 601 | ○ | ○ | ◎ | ◎ | ◎ |
| | 612 | ◎ | ○ | ○ | ◎ | ◎ |
| | 630 | | | ◎ | ∇ | Δ |

Com. Ex.: Comparative example

However, the end surface resin cover sections 40 are not limited to this. For example, the end surface resin cover sections 40 may be formed on end surfaces 102 of the crimp terminal 1 including the third resin cover section 23 in addition to the first resin cover section 21 and the second resin cover section 22 (see FIG. 4), the crimp terminal 1 including the first resin cover section 21*a*, the second resin cover section 22 and the third resin cover section 23*a* (see FIG. 7), and the crimp terminal 1 including the first resin cover section 21*a*, the second resin cover section 22, the third resin cover section 23*a*, the fourth resin cover section 24 and the fifth resin cover section 25 (see FIG. 10).

The positions at which the end surface resin cover sections 40 are formed are not limited to the end surfaces 102 of the parts of the crimp terminal 1 where the resin cover sections 20 are provided. The end surface resin cover sections 40 may be formed on exposed end surfaces of the metal plate 100, for example, end surfaces of the first transition 18, the second transition 19, the insulation barrel section 15, the box section 2 or the like.

Hereinafter, a method for producing the crimp terminal 1' including the end surface resin cover sections 40 will be described.

Figure 14A:
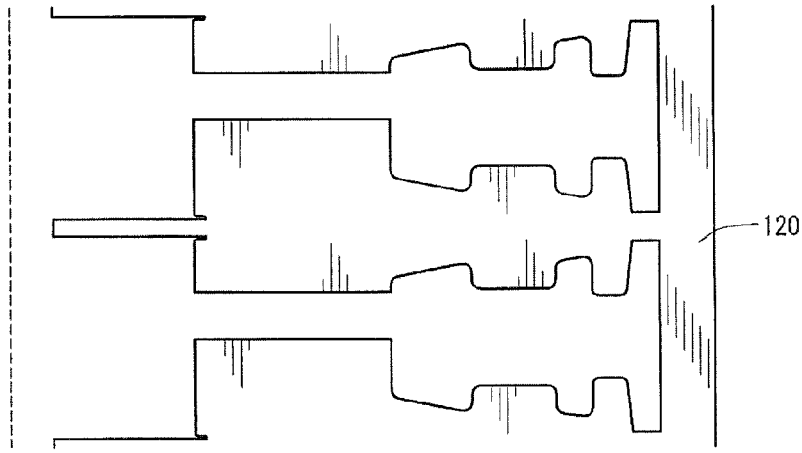
FIG. 14 shows a method for producing the crimp terminal in Example 3.
Figure 14B:
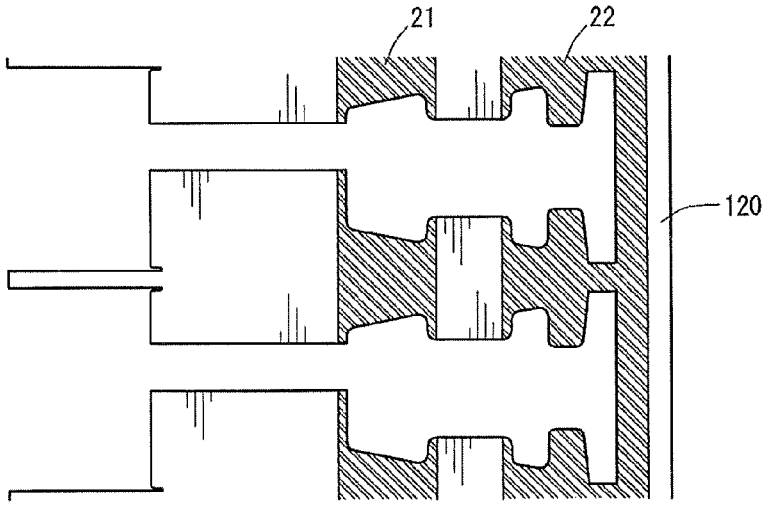

First, a tin-plated copper alloy strip having a prescribed size is punched out to form a terminal reel 120 having a shape of the connection structural body 1*a* as shown in FIG. 14(*a*). Usually, a terminal reel is formed by bending, but in this example, the terminal reel 120 is formed without bending.

The terminal reel 120 is treated with electrolytic grease removal, washing with an acid, washing with water, and drying in this order. As shown in FIG. 14(*b*), an ultraviolet-curable resin (acrylate-based resin, 3052C produced by ThreeBond Co., Ltd.) is applied to a surface of the terminal reel 120 in stripes, such that the cover thickness t will be 10 μm (±1 μm), by use of a slit die coater (produced by Itochu Sanki Kabushiki Kaisha). The resultant terminal reel is irradiated with prescribed ultraviolet rays, so that the resin is crosslinked and cured. Thus, the resin cover sections 20 (21, 22) are formed. By this method, the end surface resin cover sections 40 can be easily formed on the end surfaces 102 of the crimp terminal where the resin cover sections 20 are provided.

On the end surface-covered crimp terminal 1' having such a structure, an effect conforming test was performed to examine the effect of preventing galvanic corrosion while guaranteeing the conducting performance in the same manner as the first effect conforming test (hereinafter, this test will be referred to as the "sixth effect conforming test"). The results are shown in Table 6.

As shown in Table 6, as a result of the sixth effect confirming test, superb effects have been confirmed for all of the initial resistance and the resistance increasing value of the wire barrel section 10 and the degree of corrosion of the core wires 202. In this manner, the end surface-covered crimp terminal 1' including the resin cover sections 20 and the end surface resin cover sections 40 has been confirmed to provide a superb effect of preventing galvanic corrosion while guaranteeing the conducting performance.

Example 4

Figure 15C:
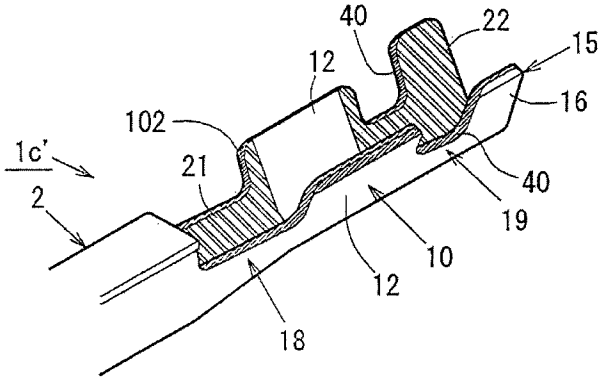
FIG. 15 shows a crimp terminal in Example 4.
Figure 15A:
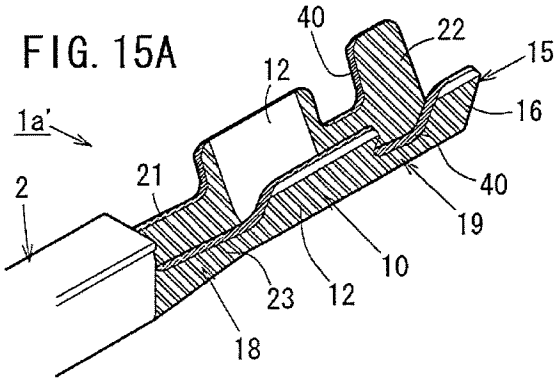
Figure 15B:
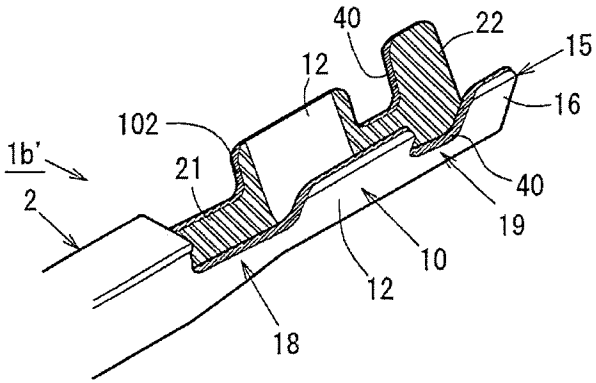

Now, end surface-covered crimp terminals 1*a*' through 1*c*' in another example will be described with reference to FIG. 15 through FIG. 17. FIG. 15(*a*) is an isometric view of the end surface-covered crimp terminal 1*a*', FIG. 15(*b*) is an isometric view of the end surface-covered crimp terminal 1*b*', and FIG. 15(*c*) is an isometric view of the end surface-covered crimp terminal 1*c*'. In FIG. 15, a front part of the box section 2 is omitted.

Figure 16A:
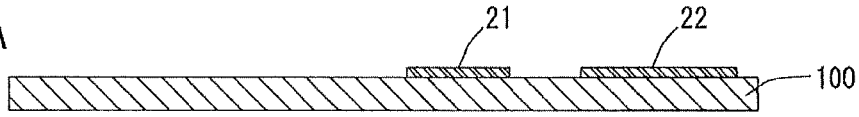
FIG. 16 shows a method for producing the crimp terminal in Example 4.
Figure 16B:
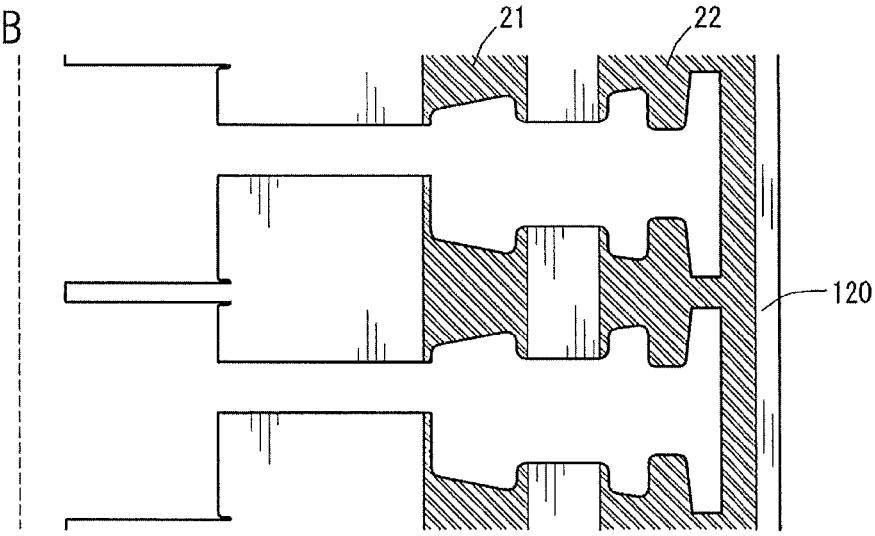
Figure 16C:
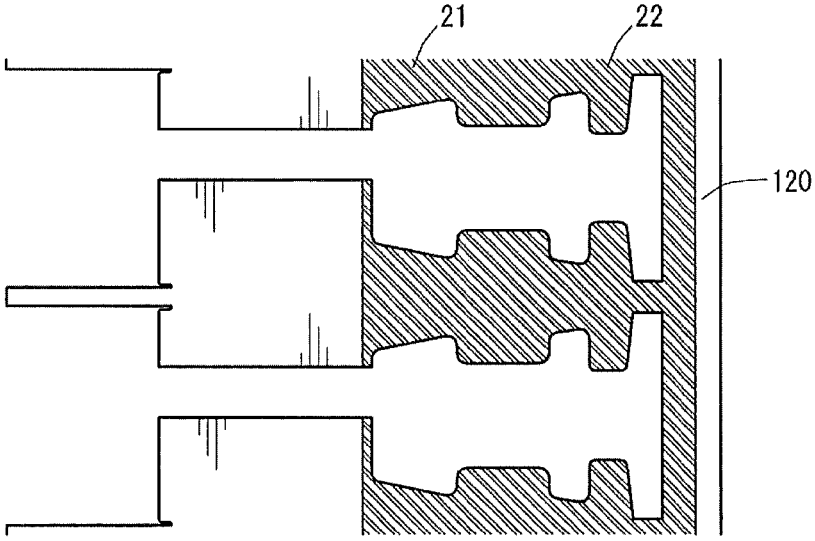

FIG. 16 shows a method for producing the end surface-covered crimp terminal 1*a*'. In more detail, FIG. 16(*a*) is a schematic cross-sectional view of the metal plate 100, which is a copper alloy strip used to form the end surface-covered crimp terminal 1*a*' (FAS680H, produced by Furukawa Electric Co., Ltd.). FIG. 16(*b*) is a plan view of the terminal reel 120 used to form the end surface-covered crimp terminal 1*a*', and FIG. 16(*c*) is a bottom view of the terminal reel 120 used to form the end surface-covered crimp terminal 1*a*'. The metal plate 100 in FIG. 16(*a*) is shown to be thicker than the actual thickness in order to clearly show the positions on the surface of the metal plate 100 at which the resin cover sections 20 are formed.

Figure 17A:
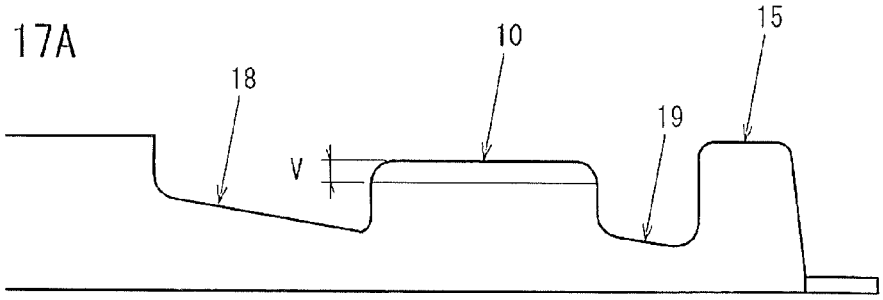
FIG. 17 shows a connection structural body and the crimp terminal in Example 4.
Figure 17B:
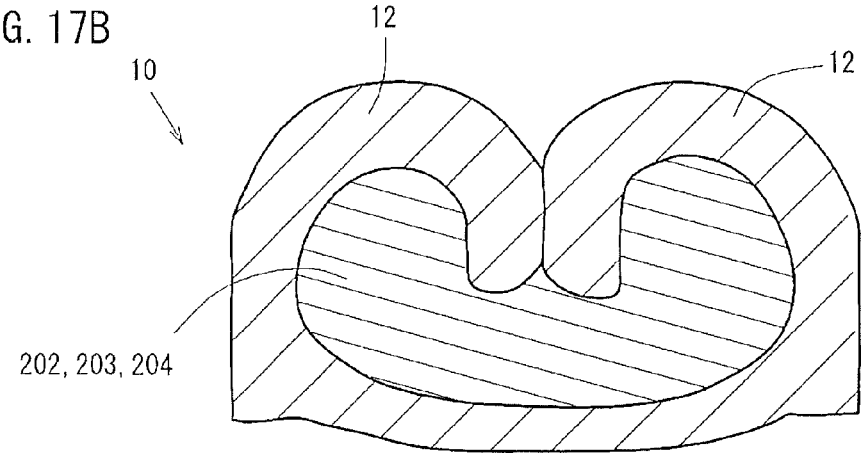
Figure 17C:
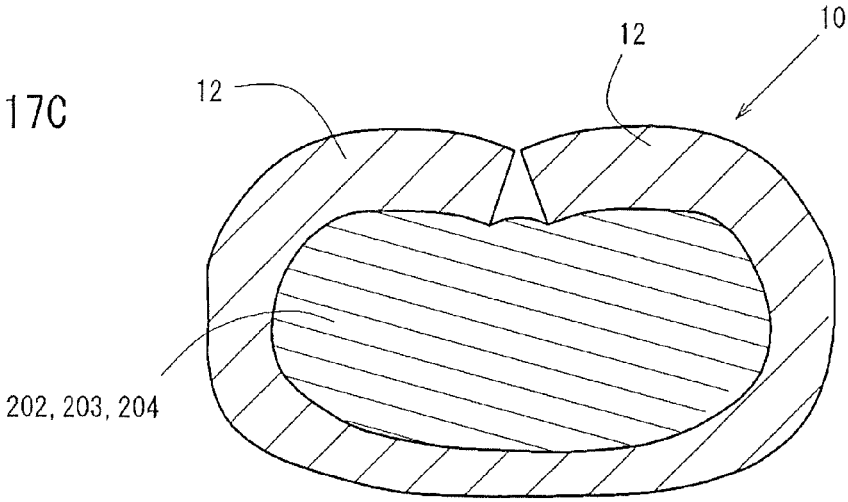

FIG. 17(*a*) is a side view of the wire barrel section 10 of the end surface-covered crimp terminal 1*c*', FIG. 17(*b*) is a cross-sectional view of the wire barrel section 10 in a sufficiently pressure-bonded state, and FIG. 17(*c*) is a cross-sectional view of the wire barrel section 10 in a state where the wire barrel section 10 is not sufficiently pressure-bonded but is practically usable. In FIG. 17(*a*), a front part of the box section 2 is omitted.

The end surface-covered crimp terminals 1*a*' through 1*c*' in this example each include the resin cover sections 20 at prescribed positions and the end surface resin cover sections 40 for covering the end surfaces 102 with a resin, like in Example 3 described above.

The end surface-covered crimp terminals 1*a*' through 1*c*' in this example will be described in more detail. The end surface-covered crimp terminal 1*a*' includes the end surface resin cover sections 40 on the end surfaces 102 of the parts of the

TABLE 6

| | No. | Example/ comparative example/ conventional example | Total biting length of resin into wire barrel [mm] | Biting length of resin into wire barrel (one side) [mm] | Biting ratio of resin into wire barrel | Post-punching-out resin cover ratio Resin area size ÷ total surface area of crimp terminal (including end surfaces) | Initial characteristics of connection structural body: Punched-out part | Initial characteristics of connection structural body: Bent part | Initial characteristics of connection structural body: Initial resistance of wire barrel | Corrosion after salt spraying: Resistance increasing value of wire barrel | Corrosion after salt spraying: Degree of corrosion of core wires |
|---|---|---|---|---|---|---|---|---|---|---|---|
| 2.3 II female | 102' | Example | 1.5 | 0.75 | 0.50 | 0.16 | ◎ | ○ | ◎ | ◎ | ◎ |
| | 111' | Example | 1.0 | 0.5 | 0.33 | 0.74 | ◎ | ○ | ◎ | ◎ | ◎ |

Com. Ex.: Comparative example crimp terminal 1 where the first resin cover section 21, the second resin cover section 22 and the third resin cover section 23 are provided, like the crimp terminal 1 shown in FIG. 4. The end surface resin cover sections 40 are formed by applying an ultraviolet-curable resin on the end surfaces 102 and curing the resin.

A method for producing the end surface-covered crimp terminal 1*a*' will be described in more detail. As shown in FIG. 16(*a*), the resin layers are formed on the metal plate 10, and the metal plate 10 is pressed to form a terminal reel having a shape of the connection structural body including the end surface-covered crimp terminal 1*a*'. In the state where the terminal reel is not bent, a resin is applied directly to the terminal reel, specifically, an area of the terminal reel corresponding to an outer surface of the crimp terminal and an area of the terminal reel corresponding to the end surfaces of the crimp terminal (end surfaces 102) so as to form the resin cover sections 20 on such areas. The areas provided with the resin are plated with tin, treated with reflow, and then bent. Thus, the crimp terminal is produced.

The application of the resin performed twice for producing the end surface-covered crimp terminal 1*a*' is conducted as follows. The metal plate 100 is treated with electrolytic grease removal, washing with an acid, washing with water, and drying in this order. A varnish (solid content: about 30%) of a polyamideimide (PAI) solution containing N-methyl 2-pyrrolidone as a solvent is applied to prescribed positions of the metal plate 100 in stripes as shown in FIG. 3(*a*), such that the post-sintering cover thickness t will be 10 μm (±1 μm), by use of a slit die coater (produced by Itochu Sanki Kabushiki Kaisha).

The end surface-covered crimp terminal 1*b*' includes the end surface resin cover sections 40 on the end surfaces 102 of the parts of the crimp terminal 1 where the first resin cover section 21 and the second resin cover section 22 for covering the inner surfaces of the first transition 18 and the second transition 19 are provided, like the crimp terminal 1 in FIG. 1. The end surface resin cover sections 40 are formed by applying an ultraviolet-curable resin on the end surfaces 102 and curing the resin.

The end surface-covered crimp terminal 1*c*' includes the end surface resin cover sections 40 provided on the same parts as those of the end surface-covered crimp terminal 1*b*'. In addition, a part of an upper outer surface of each of the wire barrel pieces 12 of the wire barrel section 10 is also covered with an ultraviolet-curable resin integrally with the parts covered with the end surface resin cover sections 40 (see FIG. 15(*c*)).

On the end surface-covered crimp terminals 1*a*' through 1*c*' having such a structure, an effect conforming test was performed to examine the effect of preventing galvanic corrosion while guaranteeing the conducting performance in the same manner as the first effect conforming test (hereinafter, this test will be referred to as the "seventh effect conforming test"). The results are shown in Table 7.

In more detail, for the seventh effect conforming test, slightly thicker core wires 202 having a conductor cross-sectional area size of 2 $mm^2$ were pressure-bonded in the wire barrel section 10 to reproduce the pressure-bonding state shown in FIG. 17(*c*). The seventh effect conforming test was performed on the resultant crimp terminal to examine the effect of preventing galvanic corrosion while guaranteeing the conducting performance in the same manner as the first effect conforming test. Such a pressure-bonding state occurs when the developed length of the wire barrel piece 12 is short, or when the crimp height at the time of pressure-bonding is high, with respect to the cross-sectional area size of the wire barrel piece 12 which is determined by the diameter and the number of the core wires. Such a pressure-bonding state of the wire barrel piece 12 is not sufficient as compared with the normal, i.e., sufficient, pressure-bonding state of the wire barrel piece 12 (see FIG. 17(*b*)), but is still practically usable. Even the pressure-bonding state shown in FIG. 17(*c*) may be practically used.

TABLE 7

| | Presence/ absence and specifications of resin on outer surface of barrel section of terminal | Presence/ absence and resin on end surface of barrel section of terminal | Resistance increasing value of pressure-bonding section | Degree of corrosion of aluminum electric wires |
|---|---|---|---|---|
| 105 | Entire surface | Absent | ○ | ○ |
| 105-01 | Entire surface | Present | ◎ | ◎ |
| 105-02 | Entire surface | Present | ◎ | ◎ |
| 102 | Absent | Absent | ○ | ○ |
| 102-01 | Absent | Present | ○ | ○ |
| 102-02 | Width: 1 mm | Present | ○ | ○ |
| 102-03 | Width: 2 mm | Present | ◎ | ◎ |
| 102-04 | Width: 3 mm | Present | ◎ | ◎ |

For the seventh effect confirming test, a 2.3II female terminal having the structure of the end surface-covered crimp terminal 1*a*' was produced as No. 105-2. For comparison, No. 105 mentioned above was used. Also for comparison, the end surface-covered crimp terminal 1' was produced as No. 105-1. No. 105-1 was produced by applying an ultraviolet-curable resin to the end surfaces 102 of the parts of the crimp terminal 1 (No. 105) where the first transition 18 and the second transition 19 were provided and then curing the ultraviolet-curable resin.

In addition, No. 102 mentioned above was used. Also, the connection structural body 1*b* was produced as No. 102-1 by forming the end surface resin cover sections 40 on the end surfaces 102 of No. 102. The end surface resin cover sections 40 were formed by applying and curing an ultraviolet-curable resin.

The end surface-covered crimp terminals 1*c*' were produced by integrally covering, with an ultraviolet-curable resin, the end surfaces 102 of No. 102 and a part of an upper outer surface of each of the wire barrel pieces 12 of the wire barrel section 10. The area size V of the part, of the upper outer surface of each of the wire barrel pieces 12 of the wire barrel section 10, which was covered with the ultraviolet-curable resin was set to 1 mm, 2 mm and 3 mm. The terminals 1*c*' with these area sizes V were numbered Nos. 102-2, 102-3 and 102-4 respectively. In Nos. 105-1 and 105-2, the area size V was the entire outer surface of the wire barrel pieces 12.

As a result of the seventh effect confirming test, it has been confirmed that in all the examples, the electric resistance increasing value after the corrosion test of all the 20 samples is less than 1 mΩ or less than 3 mΩ at the maximum, which is good.

From outside, corrosion was observed in the core wires 202. However, in a cross-section of the core wires 202 at or in the vicinity of the center of the wire barrel section 10, the core wires 202 completely remained or were merely slightly corroded. An effect of delaying corrosion was provided. Thus, it has been confirmed that the end surface-covered crimp terminals 1' and 1*a*' through 1*c*' including the end surface resin cover sections 40 provide an effect of delaying corrosion even in the pressure-bonding state shown in FIG. 17(*c*).

Regarding No. 102-3 in which the area size V of the part, of the outer surface of each wire barrel piece 12 of the wire barrel section 10, which was covered with the ultraviolet-curable resin is 2 mm, No. 102-4 in which the size V is 3 mm, and Nos. 105-1 and 105-2 in which the area size V was the entire surface, all the 20 samples exhibited a resistance increasing value of less 1 mΩ. In addition, in the cross-section of the core wires 202 at or in the vicinity of the center of the wire barrel section 10, the core wires 202 completely remained. Thus, it has been confirmed that these crimp terminals have a higher effect of suppressing the increase of electric resistance and a higher effect of delaying corrosion.

As described above, the pressure-bonding state shown in FIG. 17(*c*) is not preferable, but may occur depending on the pressure-bonding conditions. Even when such a pressure-bonding state occurs, the end surface-covered crimp terminals 1*a*' through 1*c*' have an effect of delaying corrosion of the core wires 202. It has been confirmed that by use of the end surface-covered crimp terminals 1*a*' through 1*c*', a connection state which is widely applicable and highly reliable is provided.

The connection section according to the present invention corresponds to the box section 2 in the above-described embodiment; and in the same manner, the transition section corresponds to the first transition 18 or the second transition 19;

the conductor part corresponds to the core wires 202;

the metal used to form the conductor part corresponds to aluminum;

the metal having a high potential corresponds to a copper alloy such as brass or the like, or tin plating performed on the surface of the terminal;

the metal plate corresponds to the metal plate 100;

the crimp terminal corresponds to the crimp terminal 1 or the end surface-covered crimp terminal 1';

the resin cover section corresponds to the resin cover section 20, the first resin cover section 21 or 21*a*, the second resin cover section 22, the third resin cover section 23 or 23*a*, the fourth resin cover section 24, or the fifth resin cover section 25;

the transition cover section corresponds to the first resin cover section 21 or the second resin cover section 22;

the wire barrel cover section corresponds to the biting part represented by the second biting amount L2 or the third biting amount L3 in the first resin cover sections 21 or 21*a* or the second resin cover section 22;

the length of the resin cover part of the wire barrel cover sections corresponds to the total biting length L;

the barrel length corresponds to the wire barrel length W;

the end surface cover section corresponds to the end surface cover section 40;

the exposed part corresponds to the exposed part 202*a*; and the resin for covering the exposed part corresponds to the exposed part resin cover section 30.

However, the present invention is not limited to the above-described embodiment, and can be carried out in many other embodiments.

For example, the crimp terminal 1 and the end surface-covered crimp terminals 1', 1*a*', 1*b*' and 1*c*' are female terminals, but the above-described effects are provided when the insulated wire 200 is connected to a male terminal to form the connection structural body 1*a* or 1*b*. The insulated wire 200 to be connected to the crimp terminal 1 or the end surface-covered crimp terminal 1', 1*a*', 1*b*' or 1*c*' is formed of aluminum core wires 202. Alternatively, the core wires 202 may be formed of any other metal conductors.

REFERENCE SIGNS LIST

| | |
|---|---|
| 1 | Crimp terminal |
| 1', 1a', 1b', 1c' | End surface-covered crimp terminal |
| 1a, 1b | Connection structural body |
| 2 | Box section |
| 10 | Wire barrel section |
| 15 | Insulation barrel section |
| 18 | First transition |
| 19 | Second transition |
| 20 | Resin cover section |
| 21, 21a | First resin cover section |
| 22 | Second resin cover section |
| 23, 23a | Third resin cover section |
| 24 | Fourth resin cover section |
| 25 | Fifth resin cover section |
| 30 | Exposed part resin cover section |
| 40 | End surface resin cover section |
| 100 | Metal plate |
| 102 | End surface |
| 200 | Insulated wire |
| 202 | Core wires |
| 202a | Exposed part |
| L | Total biting length |
| W | Wire barrel length |
| t | Cover thickness |

The invention claimed is:

1. A crimp terminal, comprising:

a connection section, and a pressure-bonding section including a wire barrel section and an insulation barrel section, which are provided in this order; and a transition section provided between the connection section and the wire barrel section and between the wire barrel section and the insulation barrel section;

wherein the crimp terminal is formed of a metal plate which is formed of a metal material having a higher potential than a metal material used to form a conductor part of an insulated wire which is to be pressure-bonded by the pressure-bonding section; and wherein the crimp terminal includes, in at least a part thereof, a resin cover section for covering a surface of the metal plate with a resin, wherein which includes, as the resin cover section, at least a wire barrel cover section for covering a surface of the wire barrel section; and wherein the ratio of a length of the resin cover part of the wire barrel cover sections with respect to a barrel length is 0.2 to 0.6.

2. The crimp terminal according to claim 1, which includes, as the resin cover section, at least a transition cover section for covering an inner surface of the transition section.

3. The crimp terminal according to claim 1, wherein a cover thickness of the resin cover section is 5 μm or more and 30 μm or less.

4. The crimp terminal according to claim 1, further comprising an end surface cover section for covering at least a part of an end surface of the metal plate with the resin.

5. A connection structural body, comprising a crimp terminal according to claim 1; and wherein the conductor part is pressure-bonded and connected to the pressure-bonding section of the crimp terminal.

6. A connection structural body, comprising:

a crimp terminal comprising a connection section, and a pressure-bonding section including a wire barrel section and an insulation barrel section, which are provided in this order; and a transition section provided between the connection section and the wire barrel section and between the wire barrel section and the insulation barrel section;

wherein the crimp terminal is formed of a metal plate which is formed of a metal material having a higher potential than a metal material used to form a conductor part of an insulated wire which is to be pressure-bonded by the pressure-bonding section;

wherein the crimp terminal includes, in at least a part thereof, a resin cover section for covering a surface of the metal plate with a resin; and wherein an exposed part of the conductor part in the transition section is covered with a resin.

7. The connection structural body according to claim 6, wherein the conductor part is pressure-bonded and connected to the pressure-bonding section of the crimp terminal.

8. A method for producing a crimp terminal, the crimp terminal including a connection section, and a pressure-bonding section including a wire barrel section and an insulation barrel section, which are provided in this order; and a transition section provided between the connection section and the wire barrel section and between the wire barrel section and the insulation barrel section; wherein the crimp terminal is formed of a metal plate which is formed of a metal material having a higher potential than a metal material used to form a conductor part of an insulated wire which is to be pressure-bonded by the pressure-bonding section;

the method comprising a step of forming a cover on a surface of the metal plate by applying and sintering a resin, and a step of, thereafter, treating the cover with reflow tin plating.

* * * * *